US006585303B1

(12) United States Patent
Coose et al.

(10) Patent No.: US 6,585,303 B1
(45) Date of Patent: Jul. 1, 2003

(54) DOOR LOCKING AND OPERATING MECHANISM

(75) Inventors: Ronald Coose, Oswego, IL (US); Brian Pavey, Joliet, IL (US)

(73) Assignee: R.R. Brink Locking Systems, Inc., Shorewood, IL (US)

( * ) Notice: Subject to any disclaimer, the term of this patent is extended or adjusted under 35 U.S.C. 154(b) by 156 days.

(21) Appl. No.: 09/669,356

(22) Filed: Sep. 26, 2000

Related U.S. Application Data

(60) Provisional application No. 60/156,212, filed on Sep. 27, 1999.

(51) Int. Cl.[7] ..... E05C 1/06

(52) U.S. Cl. ..... 292/144; 49/15; 49/18

(58) Field of Search ..... 292/144, 341.16, 292/341.15, 340, 138, 157; 49/18, 19, 20, 16, 326; 70/432

(56) References Cited

U.S. PATENT DOCUMENTS 4,190,985 A * 3/1980 Richards et al. ..... 49/16
4,621,451 A * 11/1986 Bruehler ..... 49/13
4,641,458 A * 2/1987 Pilcher et al. ..... 49/140
4,723,373 A * 2/1988 Jump ..... 49/18
4,872,284 A * 10/1989 Bentley ..... 49/13
4,897,959 A * 2/1990 Worden ..... 49/18
4,982,528 A * 1/1991 Michel ..... 49/16
5,241,787 A * 9/1993 Norman ..... 49/16
5,299,385 A * 4/1994 McConnell ..... 49/140
5,866,999 A * 2/1999 Schmelzer et al. ..... 318/286

* cited by examiner

*Primary Examiner*—J. J. Swann
*Assistant Examiner*—Thomas Ho
(74) *Attorney, Agent, or Firm*—Trexler, Bushnell, Giangiorgi, Blackstone & Marr, Ltd.

(57) ABSTRACT

A door locking mechanism for deadlocking a door. The door locking mechanism includes a lockhead member which includes a door stopping portion. The lockhead member is moveable from a locked position, wherein the door is double deadlocked, and an unlocked position. A vertical locking mechanism is coupled to the lockhead member, and the vertical locking mechanism deadlocks the door when the lockhead member is in the locked position. The door stopping portion of the lockhead member also deadlocks door when the lockhead member is in the locked position. A carriage assembly is engaged with the door, and the carriage assembly is engageable with the door stopping portion and moves the lockhead member from the locked position to the unlocked position. The vertical locking mechanism disengages the door when the lockhead member is in the unlocked position and the door stopping portion of the lockhead member also disengages the door.

19 Claims, 16 Drawing Sheets

DOOR LOCKING AND OPERATING MECHANISM

This patent claims benefit of a provisional Application No. 60/156,212, filed Sep. 27, 1999.

BACKGROUND

The present invention generally relates to door locking and operating mechanisms, such as to door locking and operating mechanisms which are often employed in prisons. The invention more specifically relates to a door locking and operating mechanism which can readily be configured for use with a right or left-handed door.

Typically, door locking and operating mechanisms, such as those which are often employed in prisons, are "handed," meaning that a given mechanism is configured to work either with a door which opens to the left (a "left-handed door") or with a door which opens to the right (a "right-handed door"). Specifically, a typical door locking and operating mechanism consists of several individual components, some of which are "handed." In other words, a "left-handed" mechanism (a door locking and operating mechanism which is designed for use with a left-handed door) has parts which generally cannot be readily used in a "right-handed" mechanism (a door locking and operating mechanism which is designed for use with a right-handed door). Hence, prison maintenance staff, for example, must keep in stock an inventory of "left-handed" parts (for use in a left-handed mechanism) as well as an inventory of "right-handed" parts (for use in a right-handed mechanism).

Such "handed" mechanisms also generally provide that the parts are generally widespread in the mechanism and that each part must be individually installed into a housing over a door frame. As a result, replacing an entire mechanism is generally tedious and time consuming.

Many of the mechanisms provide that a vertical lock bar locks the door in place. However, the mechanisms also provide that the vertical lock bar can be manually manipulated from the bottom of the vertical lock bar, such as by an object inserted under the door, to lift the vertical lock bar and unlock the door. Of course, in situations where it is important to have strict security, such as in prisons, this is not desirable.

OBJECTS AND SUMMARY

An object of an embodiment of the present invention is to provide a door locking and operating mechanism which is generally "non-handed" in that the mechanism can be employed with a left or right-handed door without having to substitute parts.

Another object of an embodiment of the present invention is to provide an easily attachable or detachable self-contained device mechanism plate with selectable handing for use with either left hand or right hand door housings.

Still another object of an embodiment of the present invention is to provide a door locking and operating mechanism which provides that a vertical lock mechanism cannot generally be manually manipulated from the bottom of the vertical lock bar, such as by an object inserted under the door, to lift the vertical lock bar and unlock the door.

Briefly, and in accordance with at least one of the foregoing objects, the present invention provides a door locking mechanism which includes a lockhead member which includes a door stopping portion. The lockhead member is moveable from a locked position, wherein the door is double deadlocked, and an unlocked position. A vertical locking mechanism is coupled to the lockhead member, and the vertical locking mechanism deadlocks the door when the lockhead member is in the locked position. The door stopping portion of the lockhead member also deadlocks the door when the lockhead member is in the locked position. A carriage assembly is engaged with the door, and the carriage assembly is engageable with the door stopping portion and moves the lockhead member from the locked position to the unlocked position. The vertical locking mechanism disengages the door when the lockhead member is in the unlocked position and the door stopping portion of the lockhead member also disengages the door. A motor is driveably engaged with the carriage assembly. Movement of the carriage assembly causes the carriage assembly to engage the door stopping portion of the lockhead member and move the lockhead member to the unlocked position.

BRIEF DESCRIPTION OF THE DRAWINGS

The organization and manner of the structure and function of the invention, together with further objects and advantages thereof, may be understood by reference to the following description taken in connection with the accompanying drawings, wherein like reference numerals identify like elements, and in which.

DETAILED DESCRIPTION OF THE INVENTION

Figure 1:
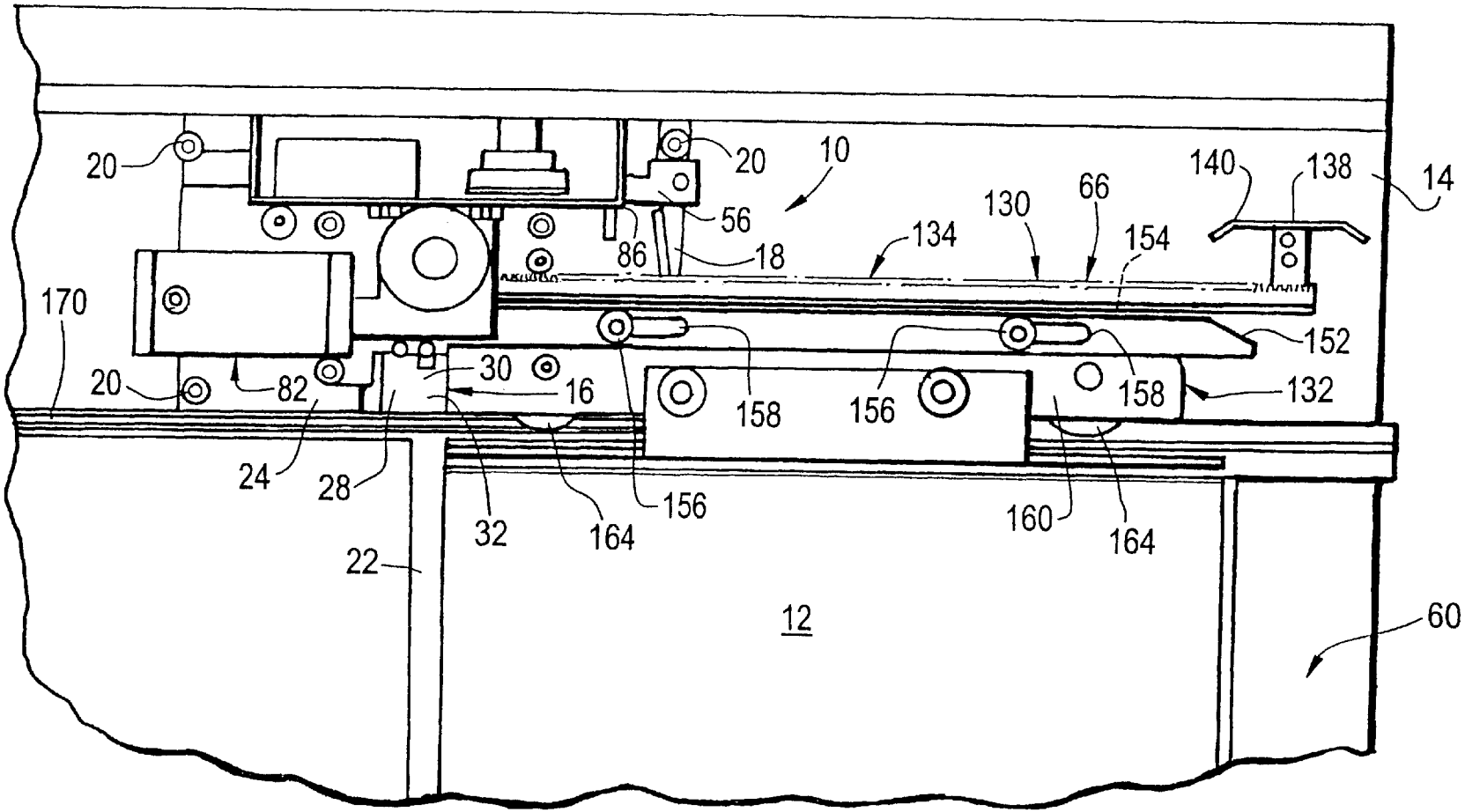
FIG. 1 is a front view of a door locking and operating mechanism, showing the mechanism mounted to a door frame and employed with a left-handed door, and showing the door in a closed position.

While the present invention may be susceptible to embodiment in different forms, there is shown in the drawings, and herein will be described in detail, embodiments with the understanding that the present description is to be considered an exemplification of the principles of the invention and is not intended to limit the invention to that as illustrated and described herein.

Figure 2:
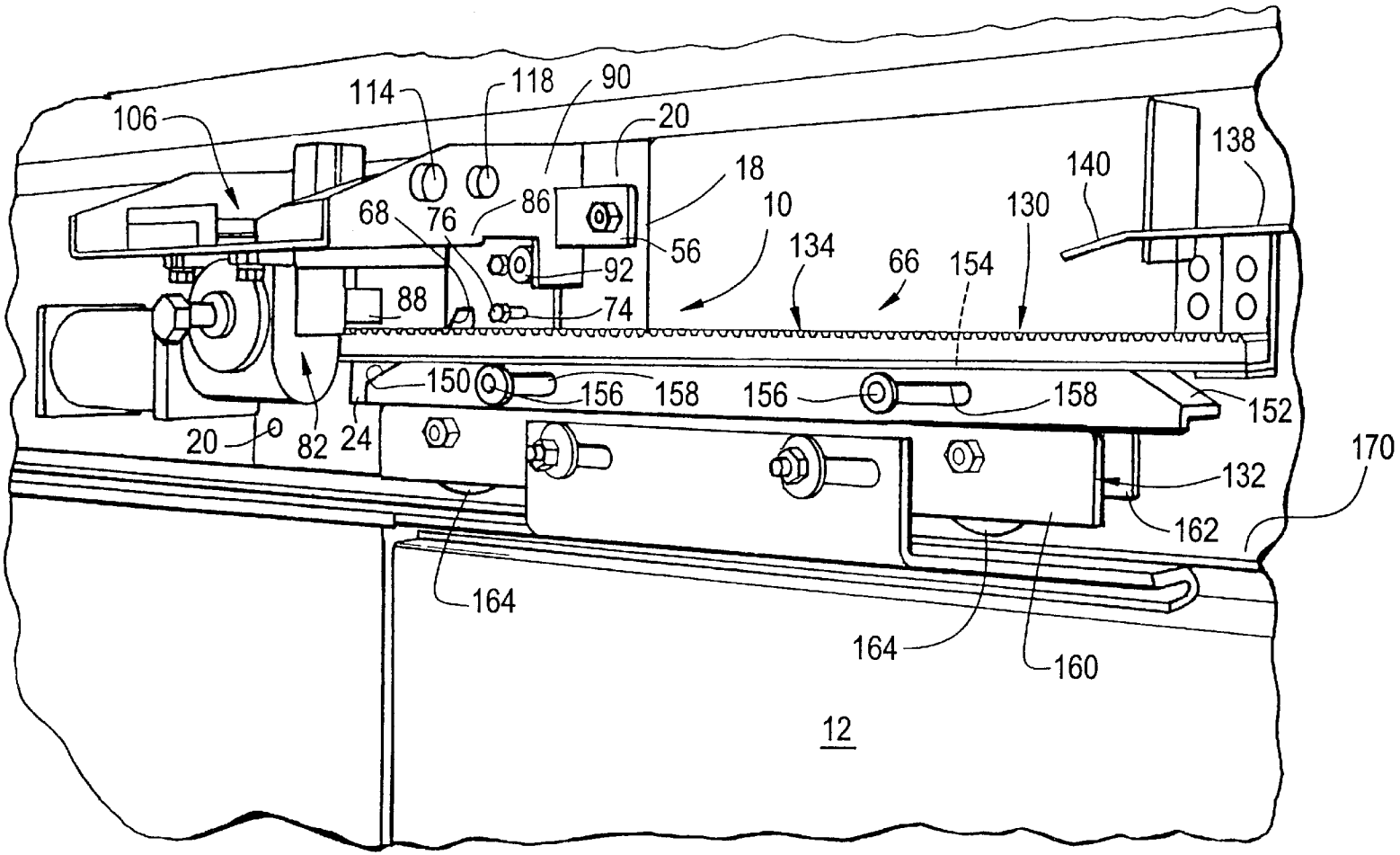
FIG. 2 is a right perspective view of the door locking and operating mechanism which is illustrated in FIG. 1, showing the mechanism employed with the door.

Illustrated in the FIGURES is a door locking and operating mechanism 10 (some FIGURES only show one or more portions of the mechanism 10) which is configured for engagement with a door 12 and a door housing 14. Specifically, the mechanism 10 is configured to open and close a door 12, and deadlock the door in place in either the open or closed position. The mechanism 10 can be utilized with a left-handed door (as shown in FIGS. 1 and 2) as well as a right-handed door, and can be easily and quickly installed or replaced. Still further, the mechanism 10 provides a vertical lock mechanism 16 which cannot generally be manually manipulated, such as by inserting an object under the door 12, to unlock the door 12 and breach security. The mechanism 10 provides still other advantages which will be evident to one having ordinary skill in the art after reviewing the following description.

As shown, the door locking and operating mechanism 10 preferably includes a mechanism plate 18 which is configured for mounting to the door housing 14 above the door 12. The mechanism plate may be a ¼"×10"×16" steel plate which is mountable to the door housing 14 using four (4) 5/16–18 cap screws 20. Preferably, the mechanism 10 is configured to be mounted generally over a center column 22 of the door housing 14, and the mechanism plate 18 provides that the mechanism 10 is generally centralized and relatively compact. This is in contrast to many prior art mechanisms which are more spread out and are not generally centrally mounted on a single plate. Instead, many prior art mechanisms have the individual components mounted directly to the door frame such that the entire mechanism cannot be replaced or installed merely by installing a single mechanism plate which has several components mounted thereon.

Figure 10:
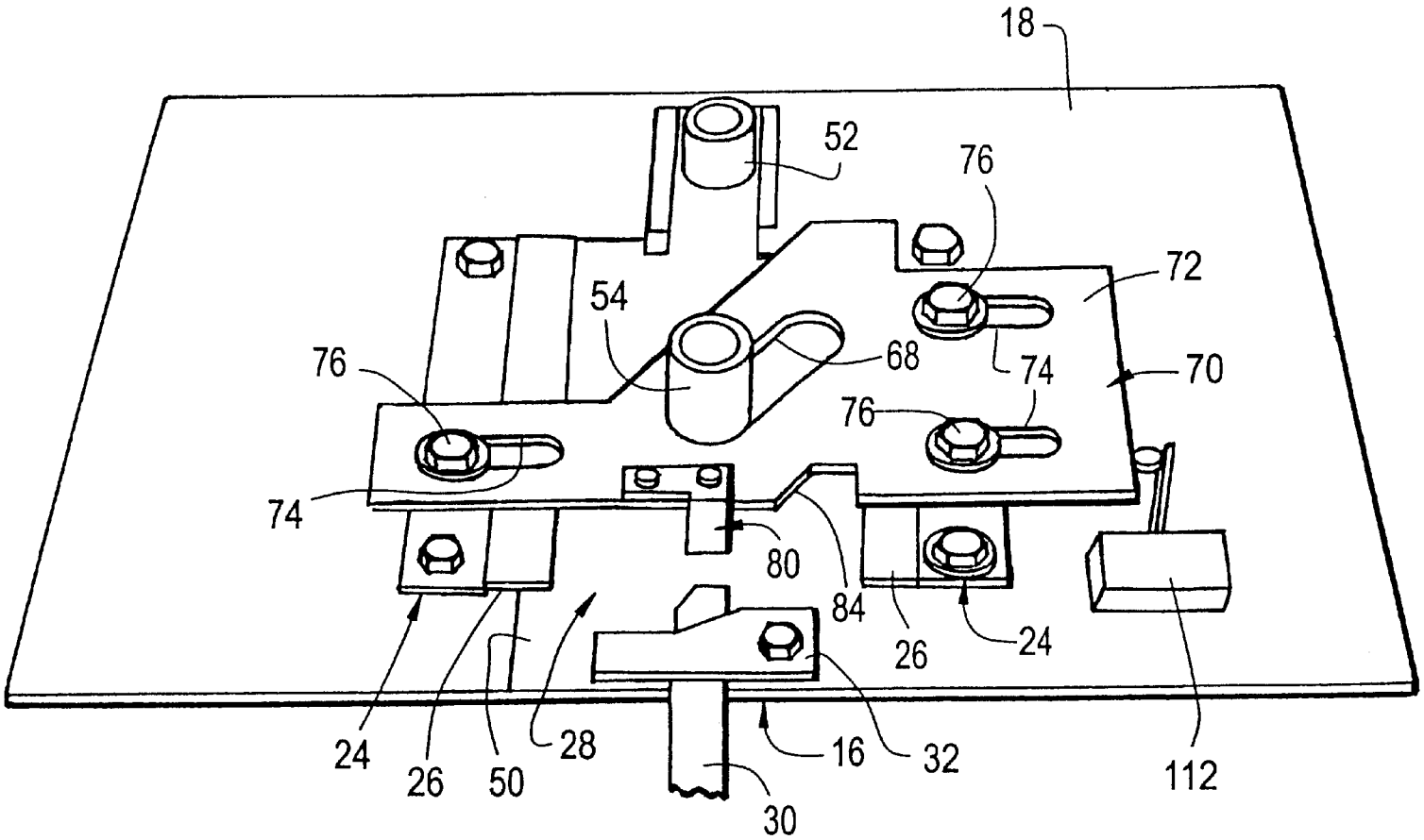
FIG. 10 is a view similar to that of FIG. 9, but omitting a motor bracket which has been removed from engagement with a mechanism plate.

As shown most clearly in FIG. 10, lockhead guides 24 are secured to the mechanism plate 18, and the lockhead guides 24 define a channel 26 which receives a lockhead member 28. The channel 26 defined by the lockhead guides 24 preferably provides that the lockhead member 28 can move generally up and down, but not side to side, relative to the mechanism plate 18 and the center column 22 of the door housing 14 (see FIG. 1).

Figure 11:
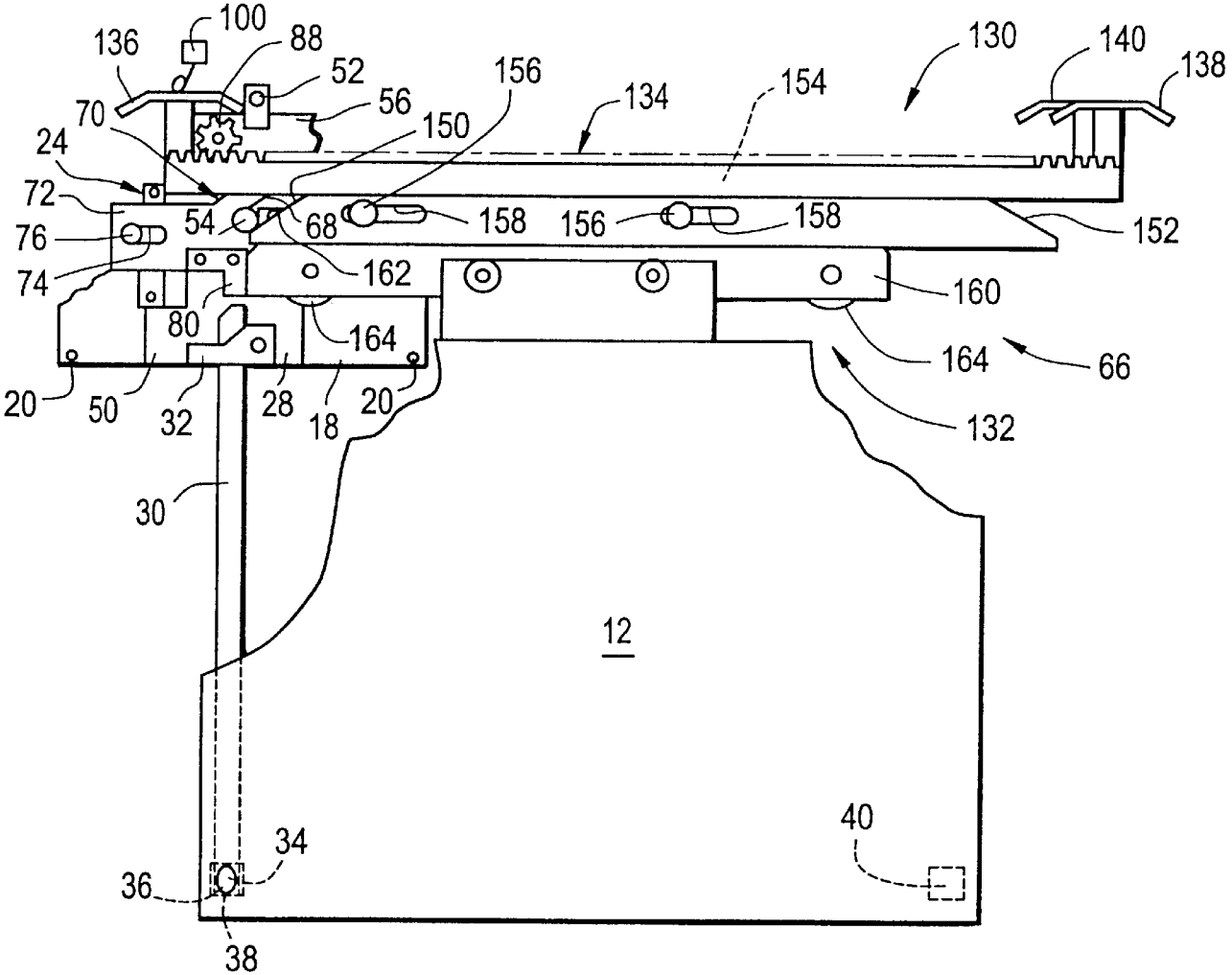
FIG. 11 is a front view of a portion of the mechanism illustrated in FIG. 1, showing the carriage assembly locked to the right of the door stopping portion of the lockhead member.
Figure 13:
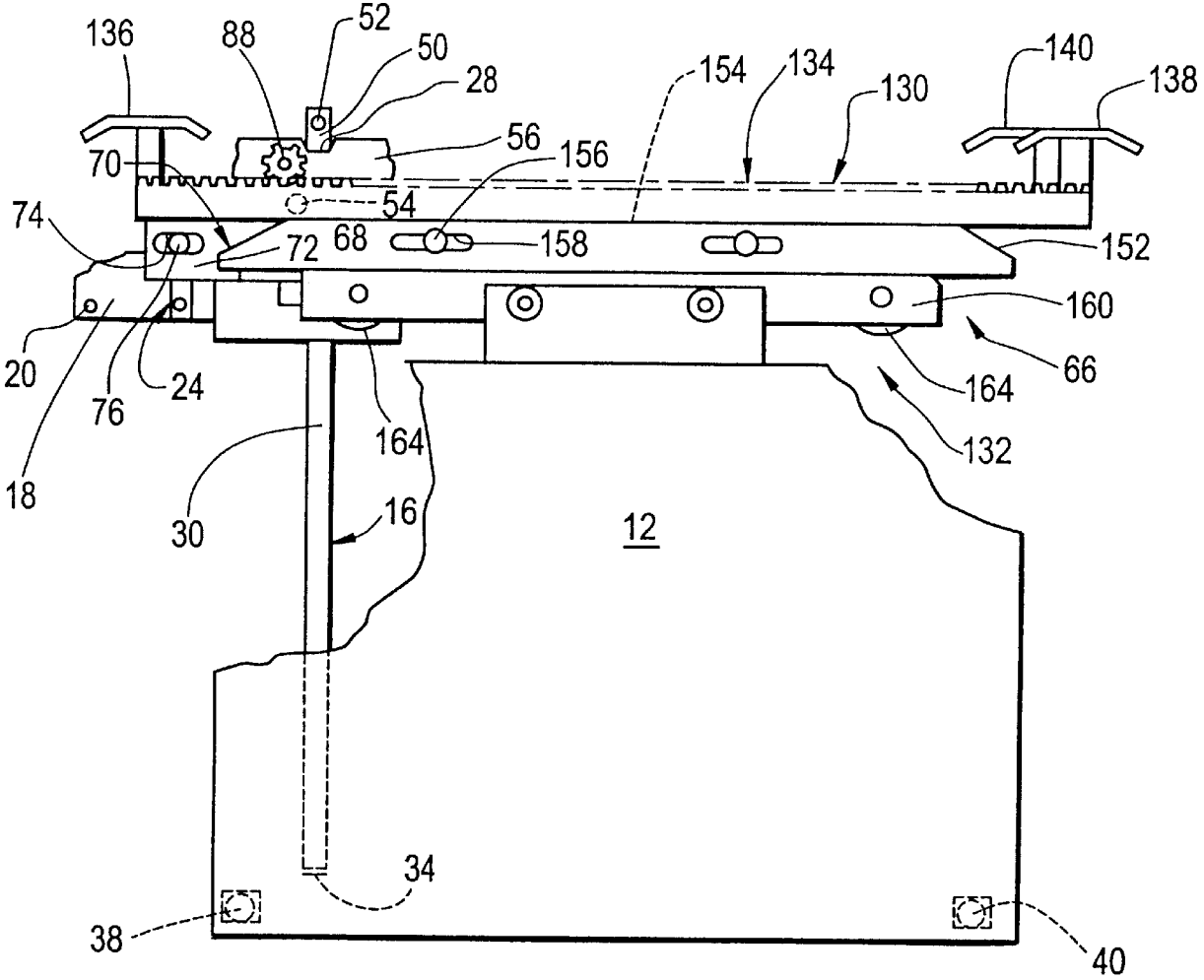
FIG. 13 is a view similar to that of FIG. 12, showing the carriage assembly being further driven to the left after the door stopping portion of the lockhead member has ridden up the incline surface of the carriage assembly.
Figure 14:
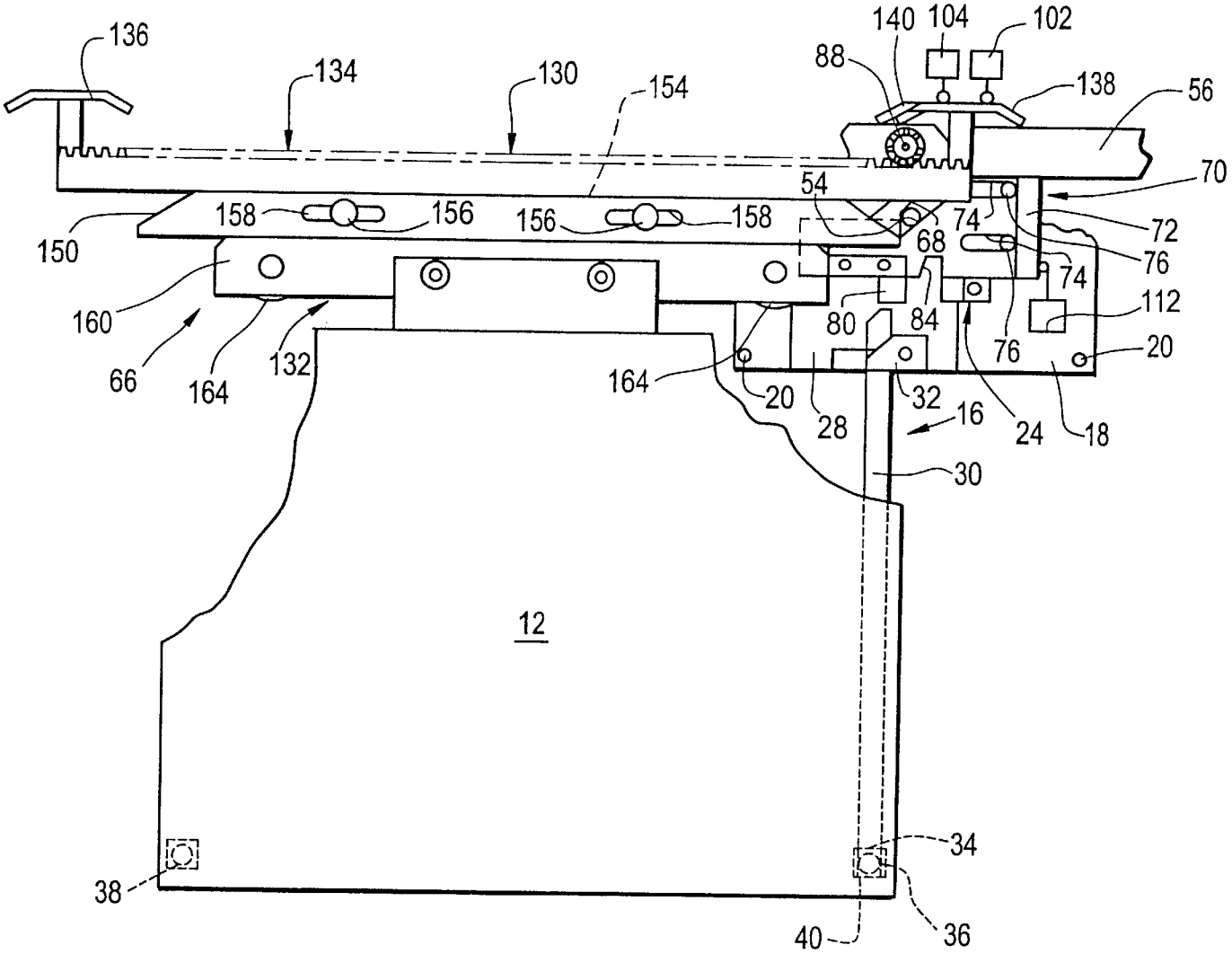
FIG. 14 is a view similar to that of FIG. 13, showing the mechanism after the door stopping portion of the lockhead member has ridden down the other incline surface of the carriage assembly, thereby deadlocking the door in the open position.

Preferably, when the lockhead member 28 moves in the channel 26, it operates a vertical locking mechanism 16 for deadlocking the door 12. As shown in FIGS. 11–15, the vertical locking mechanism 16 may consist of a vertical lock bar 30 which is pinned to the lockhead member 28 and which extends through and is generally contained in the center column 22 of the door housing 14 (see FIG. 1), otherwise referred to as the vertical lock column. As shown in FIGS. 1 and 6–15, a bracket 32 may be provided generally at the bottom of the lockhead member 28, and a pin may be secured through the bracket 32 and through the top of the vertical lock bar 30, thereby pinning the top of the vertical lock bar 30 to the lockhead member 28. As shown in FIGS. 11–15, the bottom 34 of the vertical lock bar 30 is preferably beveled and engages a steel ball 36 which is received in a recess 38, 40 in the bottom of the door 12, thereby deadlocking the door 12. Preferably, the vertical lock bar 30 and the steel ball 36 are contained within the vertical lock column 22 (see FIG. 1), and when the vertical lock bar 30 pushes down on the steel ball 36, the steel ball 36 moves out of an opening in the vertical lock column 22 into engagement with one of two recesses 38, 40 in the bottom of the door 12, thereby deadlocking the door 12 as shown in FIGS. 11 and 14. The vertical lock column 22 may be a column of 1.5" square heavy wall steel tubing.

As shown in FIGS. 11–14, preferably the door includes two recesses 38, 40—one proximate each edge of the door 12. Hence, the vertical lock bar 30 and steel ball 36 can be operated to deadlock the door 12 in both the open and closed positions. Ideally, the recesses 38, 40 in the bottom of the door 12 are also beveled, thereby providing that the steel ball 36 is generally biased into the vertical lock column 22 so the door 12 does not have a tendency to become jammed when the vertical lock bar 30 is not actively engaging the steel ball 36. While the vertical locking mechanism 16 has been described as consisting of a vertical lock bar 30, a steel ball 36 and recesses 38, 40 in the door 12 for receiving the steel ball 36 from the center column 22, one having ordinary skill in the art would recognize that the vertical locking mechanism 16 may take other forms.

Figure 5:
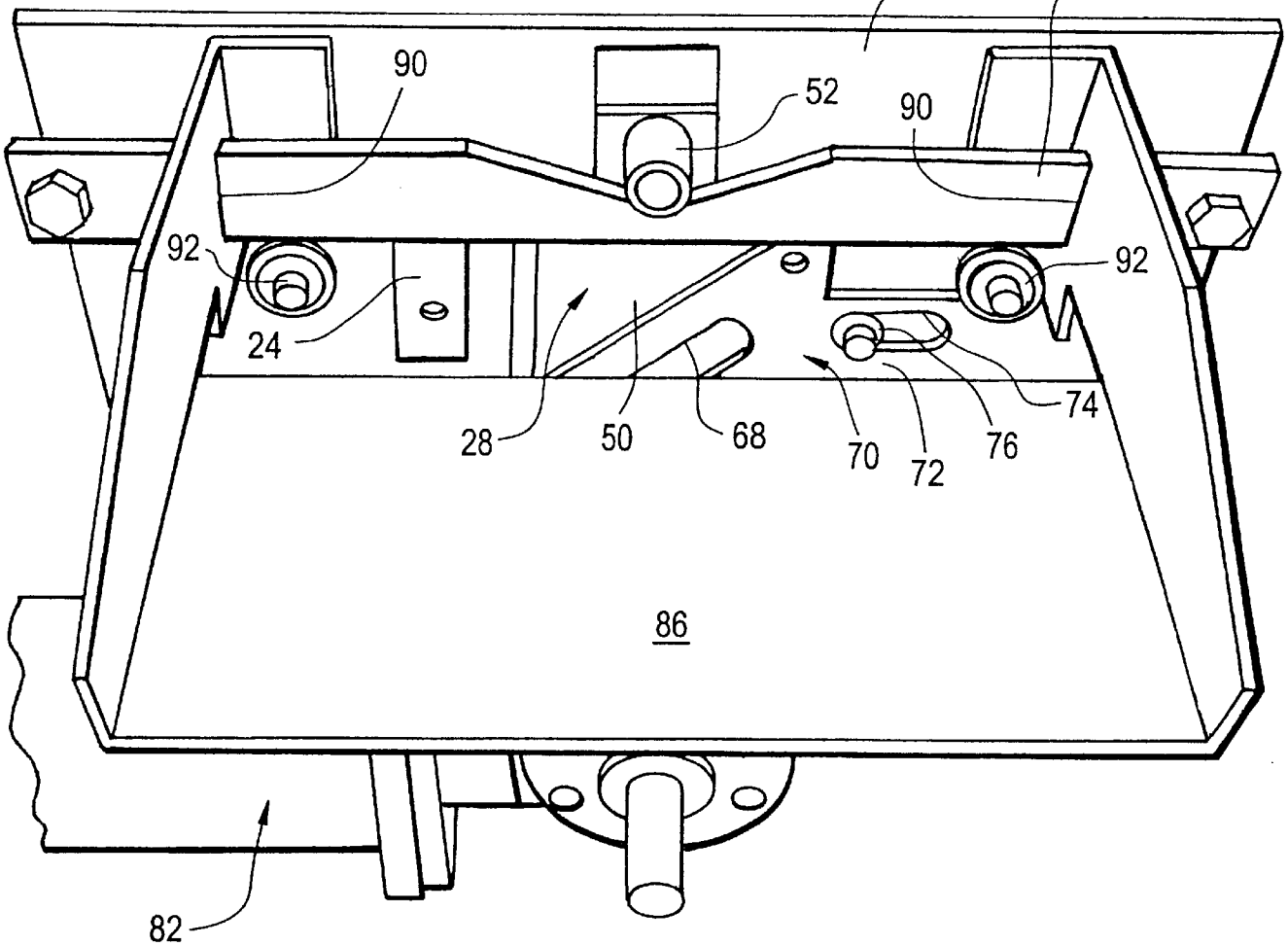
FIG. 5 is a view similar to that of FIG. 4, but omitting a panel and motor control circuit which have been removed from a motor bracket.
Figure 15:
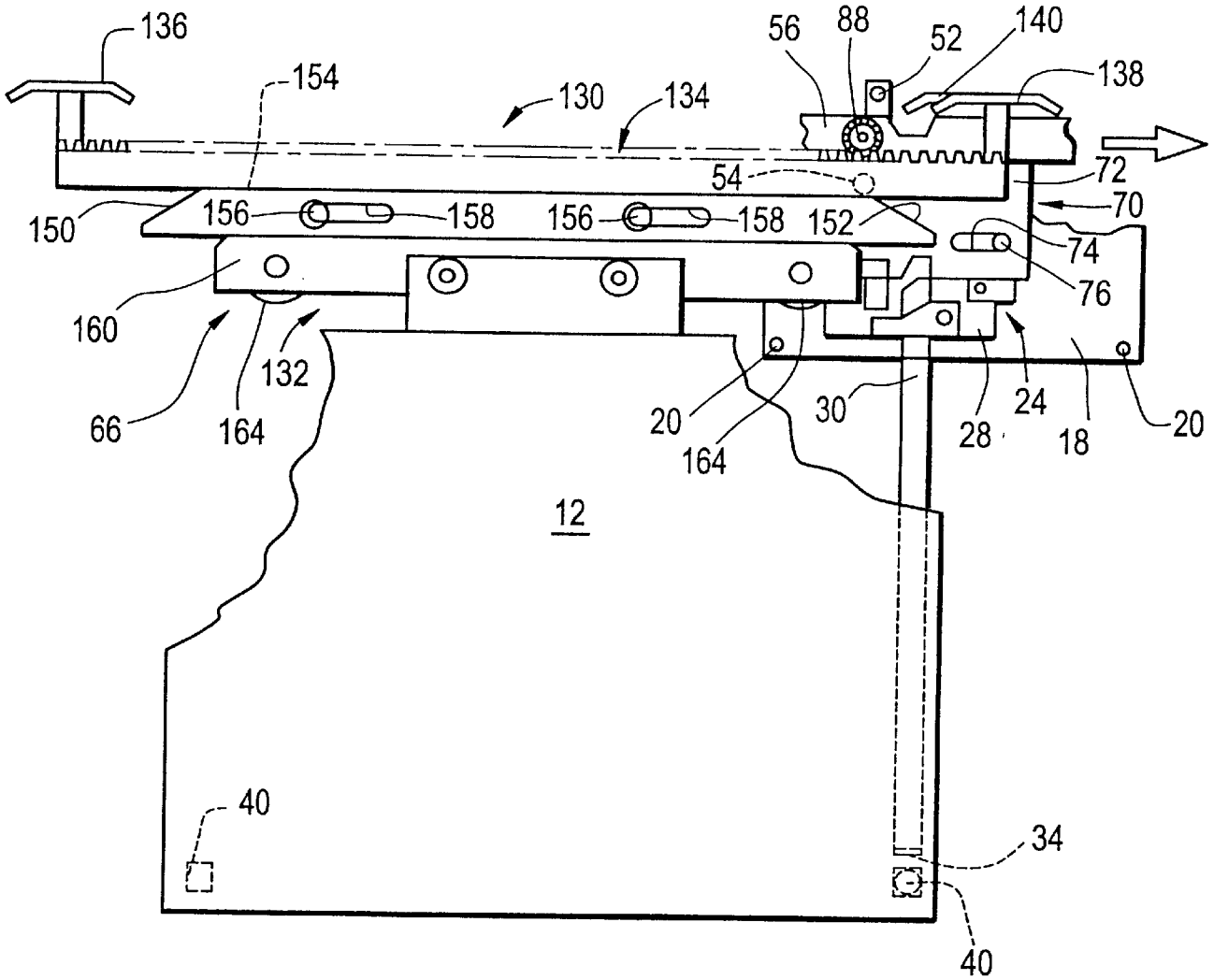
FIG. 15 is a view similar to that of FIG. 11, showing a master bar engaging the lockhead member causing the door stopping portion of the lockhead member to move out of the way of the carriage assembly and a deadlock at the bottom of the door to disengage.

As shown most clearly in FIG. 10, the lockhead member 28 preferably consists of a plate 50 which has two rollers 52, 54 pinned thereto. Preferably, an upper roller 52 is configured to be engaged by a master bar 56 as shown in FIGS. 5 and 15. As shown in FIG. 15, the master bar 56 may be manipulated to effect a gang release from a control panel 58 (see also FIG. 16) or by manually actuating a lock which is provided in a release column 60 in the door housing 14, where the release column 60 is located proximate the far edge of the door 12 when the door 12 is in the closed position (see FIG. 1). To this end, the lock (not shown) is preferably cabled up to a bell crank and to the master bar 56. One having ordinary skill in the art would recognize such an arrangement.

Figure 6:
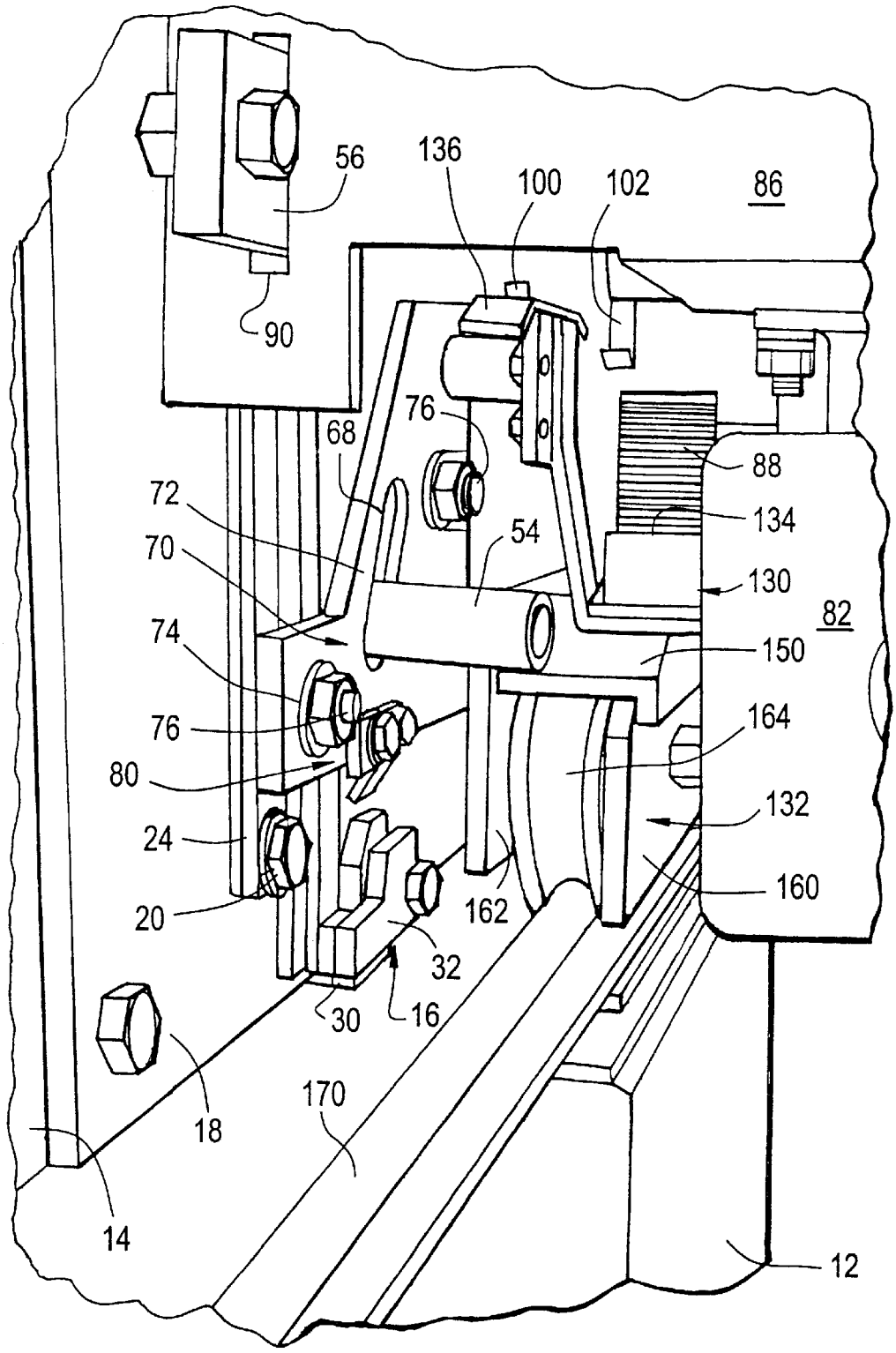
FIG. 6 is a left side perspective view of the door locking and operating mechanism which is illustrated in FIG. 1, showing a carriage assembly deadlocked behind a door stopping portion of a lockhead member of the device and showing the door stopping portion riding up an incline surface of the carriage assembly.

As shown in FIG. 15, engaging the master bar 56 with the upper roller 52 of the lockhead member 28 causes the lockhead member 28 to rise in the channel 26 defined by the lockhead guides 24, and causes the vertical locking mechanism 16 to disengage the bottom of the door 12 (e.g. causes the vertical lock bar 30 to disengage the steel ball 36 and the steel ball 36 to fall out of the respective recess 38, 40 in the bottom of the door 12 and back into the center column 22) thereby causing the door 12 to unlock at the bottom of the door 12. As shown in FIGS. 6, 11 and 14, a lower roller 54 of the lockhead member 28 is configured to engage a carriage assembly 66 which is connected to the door 12 to provide an additional deadlock near the top of the door 12, hence the lower roller 54 may be termed a door stopping portion of the lockhead member 28. This will be described in more detail later below.

As shown in FIGS. 6–12 and 14, the lower roller 54 of the lockhead member 28 is received in a slot 68, such as in a slanted slot, which is provided in a deadlock lever 70. The deadlock lever 70 preferably consists of a plate 72 which is configured to move relative to the lockhead member 28. As shown most clearly in FIGS. 9 and 10, preferably the plate 72 includes other slots 74, such as generally horizontal slots, which receive bolts 76 which are bolted to the mechanism plate 18 (and, as shown, which possibly also extend through the lockhead guides 24). The horizontal slots 74 provide that the deadlock lever 70 can move side-to-side relative to the lockhead member 28, but not up and down along with the lockhead member 28 when the lockhead member 28 moves up and down in the channel 26 defined by the lockhead guides 24 which are secured to the mechanism plate 18. The horizontal slots 74 provide that the riding of the lower roller 54 of the lockhead member 28 in the slot 68 in the deadlock lever 70 when the lockhead member 28 moves up or down in the channel 26 causes the deadlock lever 70 to move sideways relative to the lockhead member 28 and the mechanism plate 18.

As shown in FIGS. 1, 3 and 6–14, preferably the deadlock lever 70 includes a vertical locking mechanism obstructing portion 80, such as a finger bolted to the plate 72, for obstructing substantial actuation of the vertical locking mechanism 16 unless the deadlock lever 70 is first shifted sideways. Specifically, as shown in FIGS. 1, 3, 6, 8–11 and 14, the finger prevents the vertical lock bar 30 from being lifted from the bottom of the door 12, such as by sticking an object under the door 12, unless the lockhead member 28 is first lifted. As shown in FIGS. 7, 12, 13, and 15, when the lockhead member 28 is lifted in the channel 26 defined by the lockhead guides 24, such as by actuation of the master bar 56 (see FIG. 15) or by operation of a motor 82, which will be described later herein, the deadlock lever 70 shifts sideways causing the vertical locking mechanism obstructing portion 80 to mis-align from the top of the vertical lock bar 30 and the vertical lock bar 30 to lift with the lockhead member 28. As shown, the deadlock lever 70 may include a cut out 84 at the bottom thereof to provide clearance for the top of the vertical lock bar 30 when the vertical lock bar 30 is lifted along with the lifting of the lockhead member 28 and the shifting of the deadlock lever 70.

As shown in FIGS. 1–9, preferably a motor bracket 86 is secured to the mechanism plate 18, and a motor 82 is secured to the motor bracket 86. The motor 82 is preferably a ⅛ HP, 90 Volt DC variable speed, permanent magnet, right angle gear motor with a current limiting DC driver. The motor 82 may be mounted to the bottom of the motor bracket 86 and drive a pinion 88 or sprocket which engages and drives the carriage assembly 66. Specifically, as will be described more fully later below, the motor 82 drives the carriage assembly to open/close and lock/unlock the door 12.

As shown in FIGS. 1 and 4–9, preferably the bracket 86 includes slots 90 which receive the master bar 56, and two rollers 92 are secured to the motor bracket 86 and the master bar 56 rides on the rollers 92. The master bar 56 may extend to one or more other mechanisms much like the one being described and therefore operate in association with more than one door. In such a case, the master bar would be relatively long and would be carried by a plurality of sets of rollers extending across the series of mechanisms. The slots 90 allow the master bar 58 to slide and the rollers 92 function to support the master bar 58 and facilitate the shifting of the master bar 58 thereby engaging the upper roller 52 and lifting the lockhead member 28.

Figure 3:
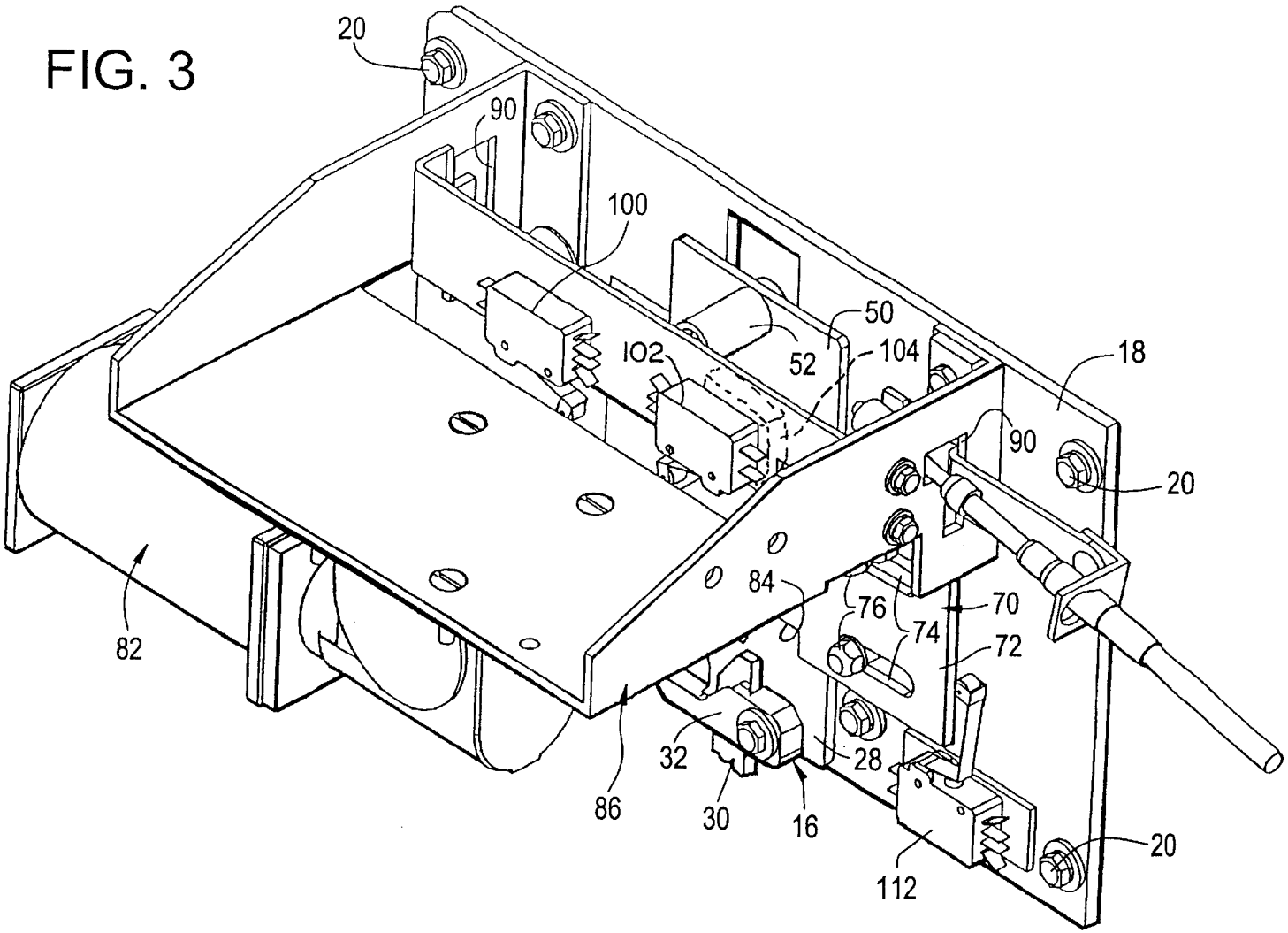
FIG. 3 is another right perspective view of the door locking and operating mechanism which is illustrated in FIG. 1, omitting a carriage assembly which has been removed from engagement with a motor of the mechanism and omitting a master bar of the mechanism.
Figure 4:
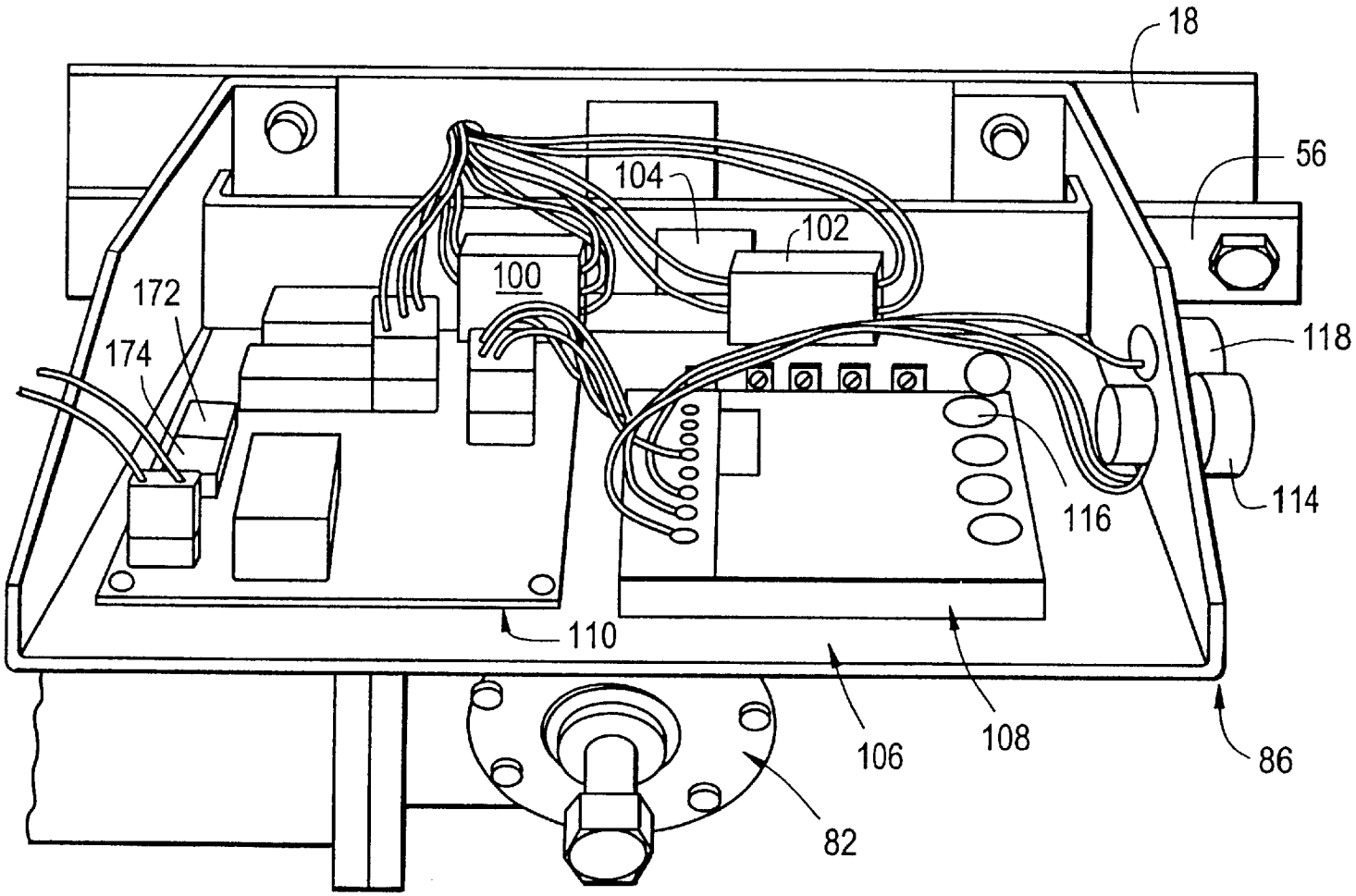
FIG. 4 is a top perspective view of the door locking and operating mechanism which is illustrated in FIG. 1, omitting a carriage assembly which has been removed from engagement with a motor of the mechanism.

As shown in FIGS. 3 and 4 (see also FIGS. 11 and 14), preferably a plurality of limit switches 100, 102, 104 are mounted to the motor bracket 86, and the limit switches 100, 102, 104 are configured to sense the carriage assembly 66. The limit switches 100, 102, 104 are connected to a motor control circuit 106 (see, for example, FIGS. 4 and 16) which, preferably is mounted to the motor bracket 86, such as on the top of the motor bracket 86, opposite the motor 82. Specifically, the motor control circuit 106 may include a circuit board 108 as well as a relay connection board 110 which provides easy access to relays and wiring connections. The motor control circuit 106 is connected to and controls the operation of the motor 82 depending on what is sensed by the limit switches 100, 102, 104 and depending on commands which are received from an operator through a control panel 58 (see FIG. 16). As will be described later herein, operation of the motor 82 drives the door 12 opened or closed.

Figure 16:
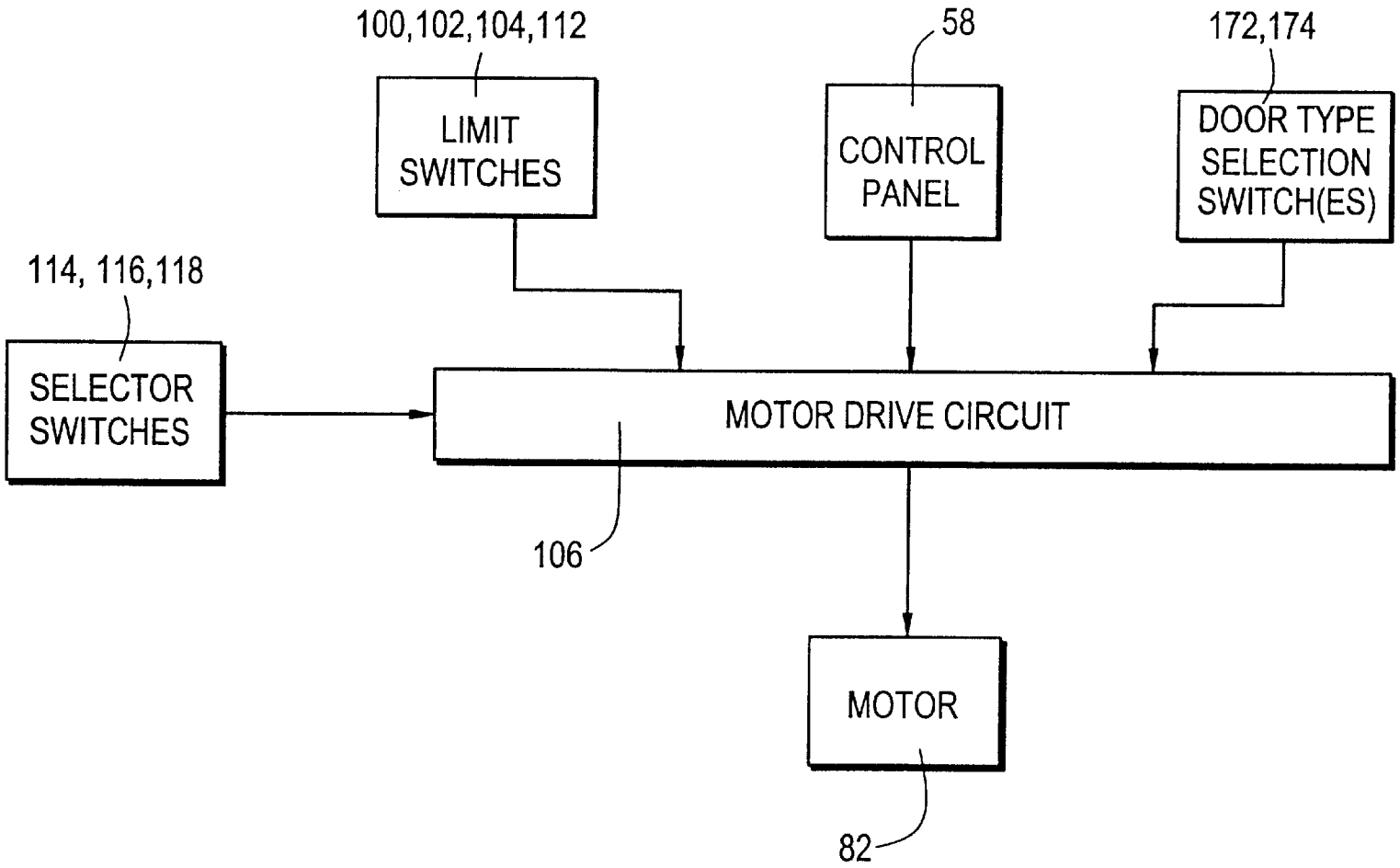
FIG. 16 is a block diagram of electronics of the mechanism shown in the previous FIGURES.

As shown in FIGS. 7–10, still another limit switch 112 may be mounted to the mechanism plate 18 and may be connected to the motor control circuit 106 for sensing the deadlock lever 70 and indicating to the motor control circuit 106 when the door 12 is deadlocked. The motor control circuit 106 is preferably configured to operate on either a 120 VAC or 24 Volt DC control and a 120 VAC power source. As shown in FIG. 16, preferably the motor control circuit 106 is connected to an indication device, such as to a control panel 58 (see FIG. 16), which indicates whether the door. 12 is opened or closed and whether the door 12 is deadlocked, depending on what is sensed by the limit switches 100, 102, 104, 112. The motor control circuit 106 may also be configured to indicate, using the indication device (e.g. the control panel 58) when the door 12 is in neither the open or closed position. In the case where the motor control circuit 106 is connected to a control panel 58, which is preferred, the control panel 58 is configured to accept commands from an operator and to control the motor control circuit 106 to open and close, and lock and unlock the door 12. Additionally, the control panel 58 indicates the status of the door 12, such as whether the door 12 is open or closed and whether the door 12 is deadlocked. Of course, the control panel 58 may be wired to control and indicate the status of many doors, such as all the doors in a prison block.

As shown in FIGS. 2, 4, 7, and 8, preferably a selector switch 114 is mounted to the motor bracket 86 and is connected to the motor control circuit 106, and can be used to set the speed at which the motor 82 drives the door 12. In the case of a relatively small door, it may be desirable to set the speed relatively slow, whereas in the case of a relatively large door, it may be desirable to set the speed relatively fast. The motor control circuit 106 may also include a selector switch 116 (see FIG. 4) for setting the "blocking force" of the door 12, where the blocking force is the force it takes to stop the door 12 while the door 12 is moving, such as while it is being driven closed by the motor 82. While it may be desirable to set the blocking force low if the door 12 is located in a corridor of a prison, it may be desirable to set the blocking force high if the door 12 is a cell door in a prison. The mechanism 10 preferably provides that a blocking force does not cause damage to the mechanism 10.

Another selector switch 118 may be mounted on the motor bracket 86 and be connected to the motor control circuit 106 for setting a "soft stop" feature of the mechanism 10. Specifically, the switch 118 may be set to select how much the door 12 slows down during the last portion of its range of movement in the closing direction. If the soft stop feature is provided, preferably a third limit switch 104 is mounted on the motor bracket, as shown in FIG. 4, and is connected to the motor control circuit 106 for sensing the carriage assembly 66 and indicating to the motor control circuit 106 when the door 12 is almost closed. The soft stop feature and other features of the opening and closing of the door 12, including the function and operation of all of the limit switches 100, 102, 104, 112 mentioned hereinabove, will be described more fully later herein.

As shown in FIGS. 1, 2, 6–8 and 11–15, the carriage assembly 66 preferably consists of two portions which are moveable relative to each other—a driven portion 130 and a following portion 132. The driven portion 130 is configured to be driven by the motor 82, such as by a pinion 88 or sprocket which is driven by the motor 82. To this end, the driven portion 130 of the carriage assembly 66 preferably includes a geared rack 134 which is configured for engagement with the pinion 88 driven by the motor 82. Alternatively, the driven portion 130 of the carriage assembly 66 may include a chain and a pair of positioning sprockets which engage the chain. In such a case, the chain would engage a sprocket which is driven by the motor 82, and the sprocket which is driven by the motor 82 would engage the chain between the two positioning sprockets.

Regardless of whether the driven portion 130 of the carriage assembly 66 includes a geared rack 134 or a chain, preferably the carriage assembly 66 is configured to trip limit switches 100, 102, 104 mentioned hereinabove. Specifically, the carriage assembly 66 may include a plurality of extensions, or trippers, which are configured to trip the limit switches. Even more specifically, the carriage may include three trippers 136, 138, 140 for tripping each of the three different limit switches 100, 102, 104 which are mounted on the motor bracket 86, wherein a first tripper 136 is generally at one end of the carriage assembly 66 and is configured to trip limit switch 100 to indicate to the motor control circuit 106 that the door 12 is in the open position, and wherein tripping the limit switch 100 causes the motor control circuit 106 to stop the motor 82 and indicate on the control panel 58 that the door 12 is open. A second tripper 102 is generally at the opposite end of the carriage assembly 66 and is configured to trip limit switch 102 on the motor bracket 86 to indicate to the motor control circuit 106 that the door 12 is in the closed position, wherein tripping the limit switch 102 causes the motor control circuit 106 to stop the motor 82 and indicate on the control panel 58 that the door 12 is closed. An additional, third tripper 140, somewhat longer than the second tripper 138, may be generally at the same end of the carriage assembly 66 as the second tripper 138 (on a right-handed door, the third tripper 140 would be provided generally at the same end of the carriage assembly 66 as the first tripper 136) and be configured to trip the third limit switch 104 on the motor bracket 86 to indicate to the motor control circuit 106 that the door 12 is almost in the closed position, wherein tripping the limit switch 104 causes the motor control circuit 106 to slow the motor 82 down and effect a soft stop of the door 12. Of course, the third limit switch 104 on the motor bracket 86 and the third tripper 140 on the carriage assembly 66 may or may not be included depending on whether a soft stop feature is desired.

Figure 7:
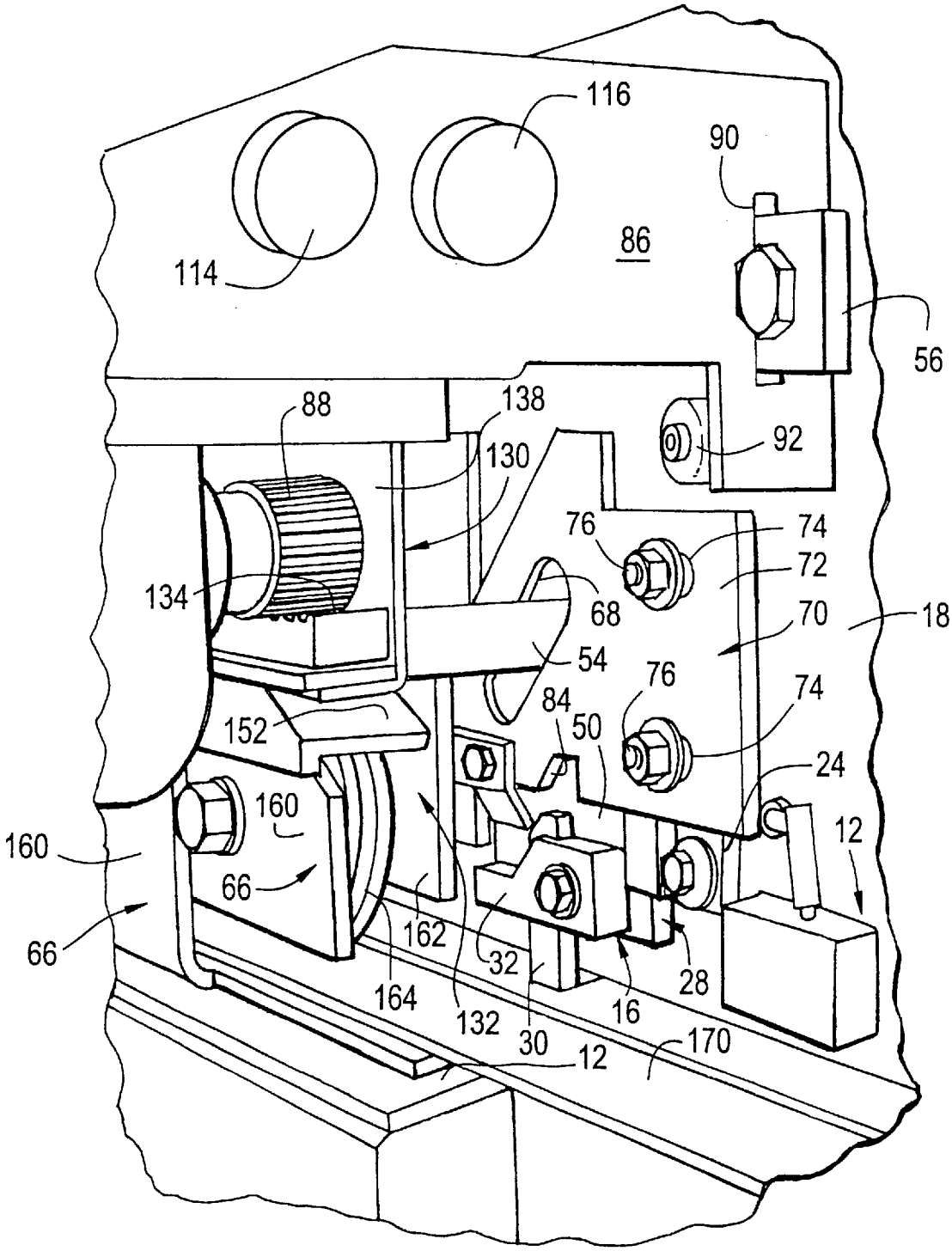
FIG. 7 is a right side perspective view of the door locking and operating mechanism which is illustrated in FIG. 1, showing the door stopping portion of the lockhead member before it rides down another incline surface of the carriage assembly.

In addition to the geared rack 134 (or the chain) and the trippers, the driven portion 130 of the carriage assembly 66 also preferably includes two incline surfaces 150, 152 for engaging the door stopping portion 54 of the lockhead member 28 as well as a generally level surface 154 which generally spans between the incline surfaces 150, 152. Engagement of either incline surface 150 or 152 with the door stopping portion 54 of the lockhead member 28 causes the door stopping portion 54 to ride up the incline surface 150, 152 to the generally level surface 154, thereby causing the lockhead member 28 to rise in the channel 26 defined by the lockhead guides 24, and cause the deadlock lever 70 to shift sideways. As shown in FIGS. 7 and 13, this causes the door stopping portion 54 to no longer block movement of the following portion 132 of the door 12, and causes the vertical locking mechanism 16 to disengage the door 12. Hence, the door 12 is unlocked from the top and bottom of the door 12, and the door can be driven open or closed by the motor 82.

As shown in FIGS. 1, 2 and 11–15, the driven portion 130 of the carriage assembly 66 is keyed to the following portion 132 of the carriage assembly 66, such as by bolts 156 on the driven portion 130 which are received in horizontal slots 158 on the following portion 132. Such a configuration provides that when the driven portion 130 is initially driven by the motor 82, the driven portion 130 can move even though the door stopping portion 54 of the lockhead member 28 initially prevents substantial movement of the following portion 132 of the carriage assembly 66. As the driven portion 130 is moving, the bolts 156 ride in the slots 158 and after the door stopping portion 54 of the lockhead member 28 rides up the respective incline surface 150, 152 of the driven portion 130 to the generally level surface 154 which generally spans the incline surfaces 150, 152 the driven portion 130 pulls the following portion 132. The following portion 132 is engaged with, such as bolted to, the door 12, therefore, as the following portion 132 moves, the door 12 also moves.

Figure 12:
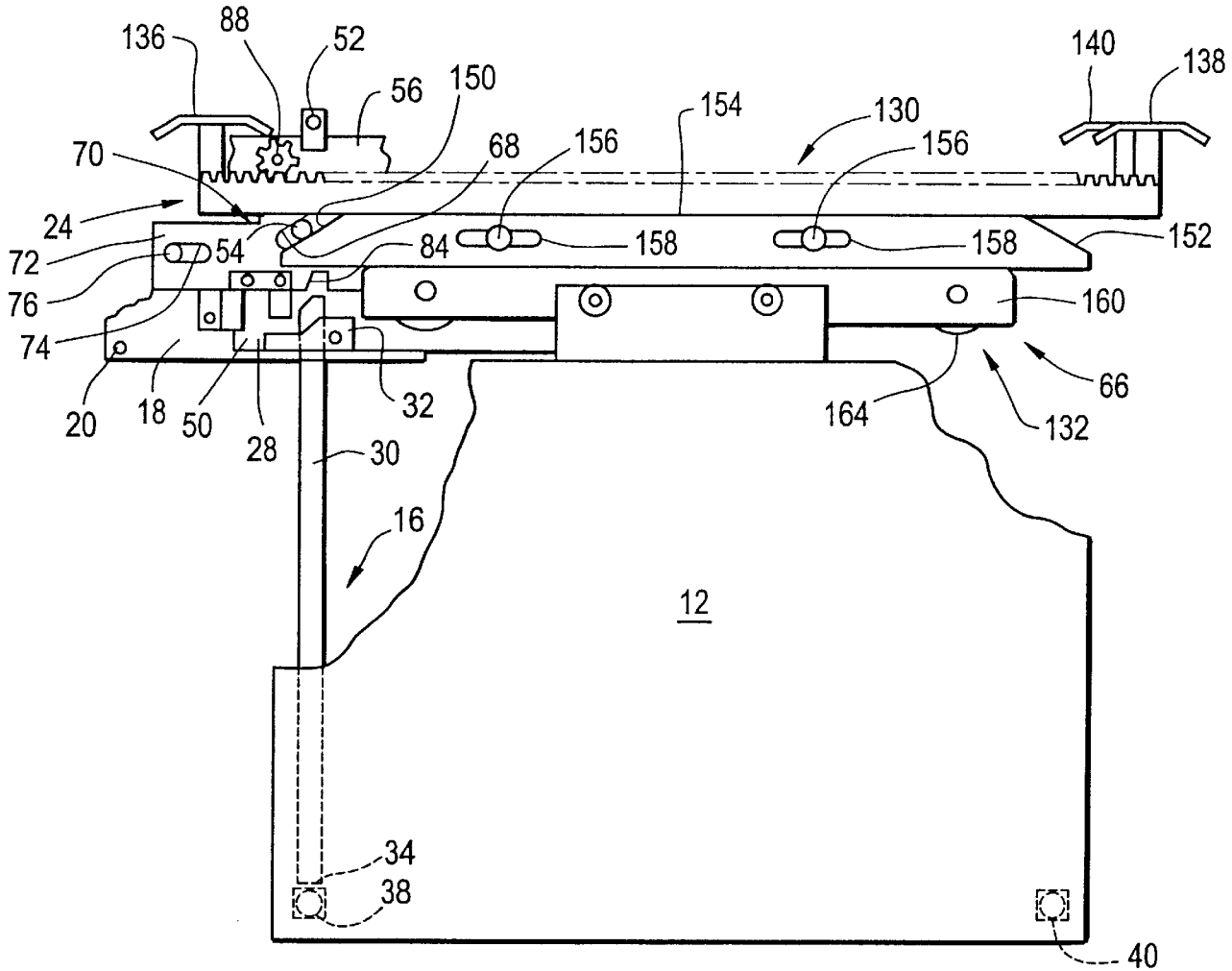
FIG. 12 is a view similar to that of FIG. 11, showing the carriage assembly being driven to the left thereby causing the door stopping portion of the lockhead member to ride up an incline surface of the carriage assembly.

As shown in FIGS. 6 and 12, as the door 12 is driven open, the door stopping portion 54 rides up one incline surface (thereby unlocking the door) 150, rides across the generally level surface 154 (see FIG. 13) which spans the incline surfaces 150, 152 and rides down the other incline surface 154 to again deadlock the door 12 as shown in FIG. 14. Of course, as the door stopping portion 54 rides up the one incline surface 150, the lockhead member 28 rises and the deadlock lever 70 shifts thereby causing the vertical locking mechanism 16 to release the door 12 (see FIGS. 7 and 12), and as the door stopping portion 54 of the lockhead member 28 rides down the other incline surface 152, the lockhead member 28 lowers and the deadlock lever 70 shifts back thereby causing the vertical locking mechanism 16 to again engage the door 12 (see FIG. 14). Hence, as the lockhead member 28 rises, the door 12 is double unlocked and as the lockhead member 28 lowers back into place in the channel 26, the door 12 is again double deadlocked.

The following portion 132 may be a travel bar assembly consisting of a pair of panels 160, 162 which are generally parallel to each other and have a pair of rollers 164 pinned therebetween. As shown in FIGS. 1, 2 and 6–8, the pair of rollers 164 are configured to ride on a guide member 170 or track on the door housing 14 and may be 3¾" outside diameter turned steel with a double-shielded ball bearing attached to the carriage with a high tensile steel bolt and lock nut. Specifically, the guide member 170 may be a cylindrical metal bar which is welded to the door housing 14.

Preferably, as shown in FIGS. 2 and 6–8, the rear panel 162 of the travel bar assembly extends further upward than the front panel 160 of the assembly. The front panel 160 of the assembly is preferably what has the horizontal slots 158 formed therein for receiving the bolts 156 of the driven portion 130 of the carriage assembly 66. As shown, preferably it is also the front panel 160 of the travel bar assembly which is secured to the door 12. Preferably, the door 12 is attached via eccentric bushings to allow vertical door adjustment.

Figure 8:
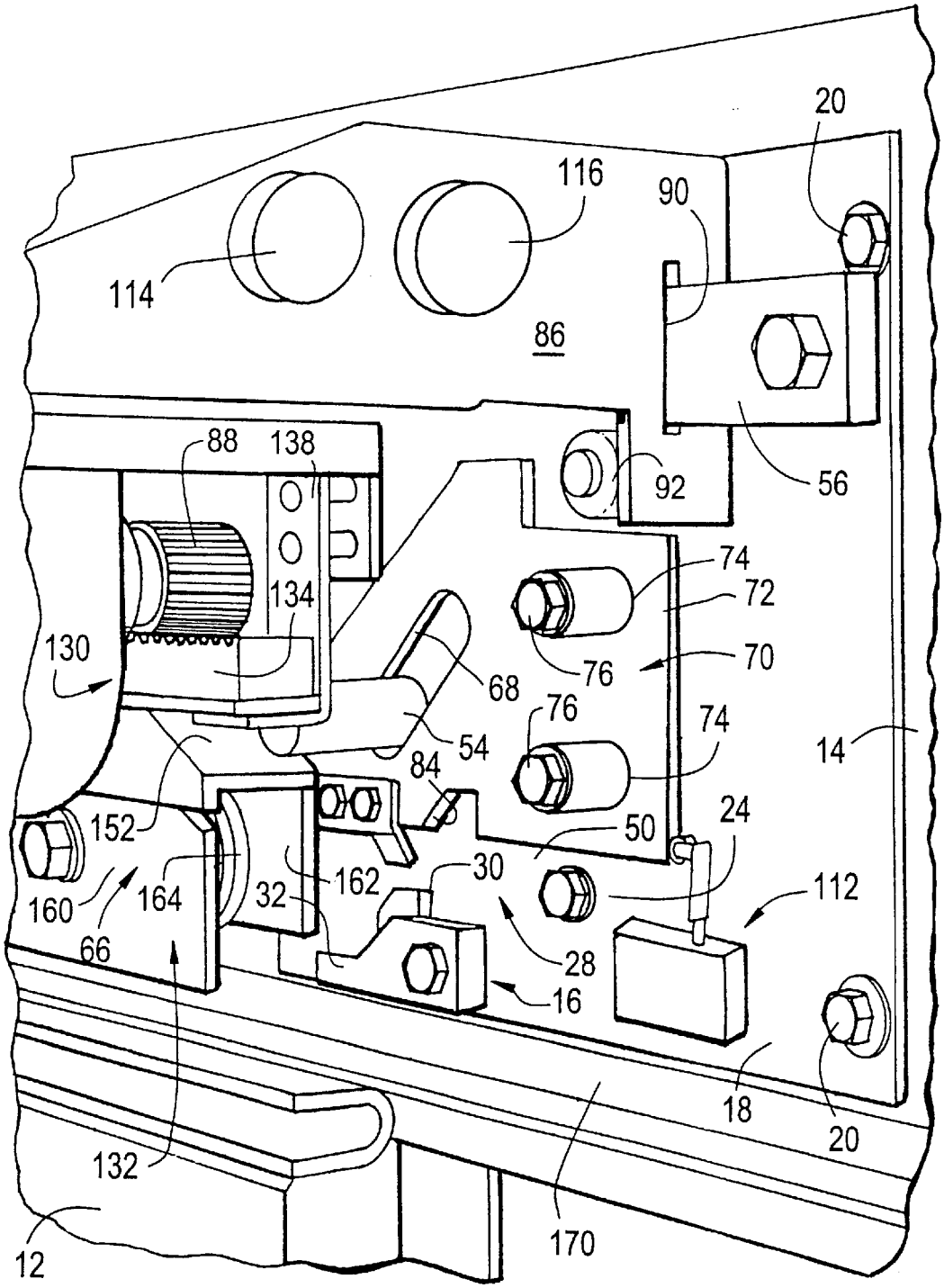
FIG. 8 is a view similar to FIG. 7, showing the door stopping portion of the lockhead member of the device riding down the other incline surface of the carriage assembly to deadlock the door in an open position.

As mentioned above, the door stopping portion 54, when the lockhead member 28 is down in the channel 26, aligns adjacent the carriage assembly 66 to deadlock the door 12 (see FIGS. 8, 11 and 14). Specifically, it is the sides of the rear panel 162 of the travel bar assembly with which the door stopping portion 54 of the lockhead member 28 engages to deadlock the door 12.

Figure 9:
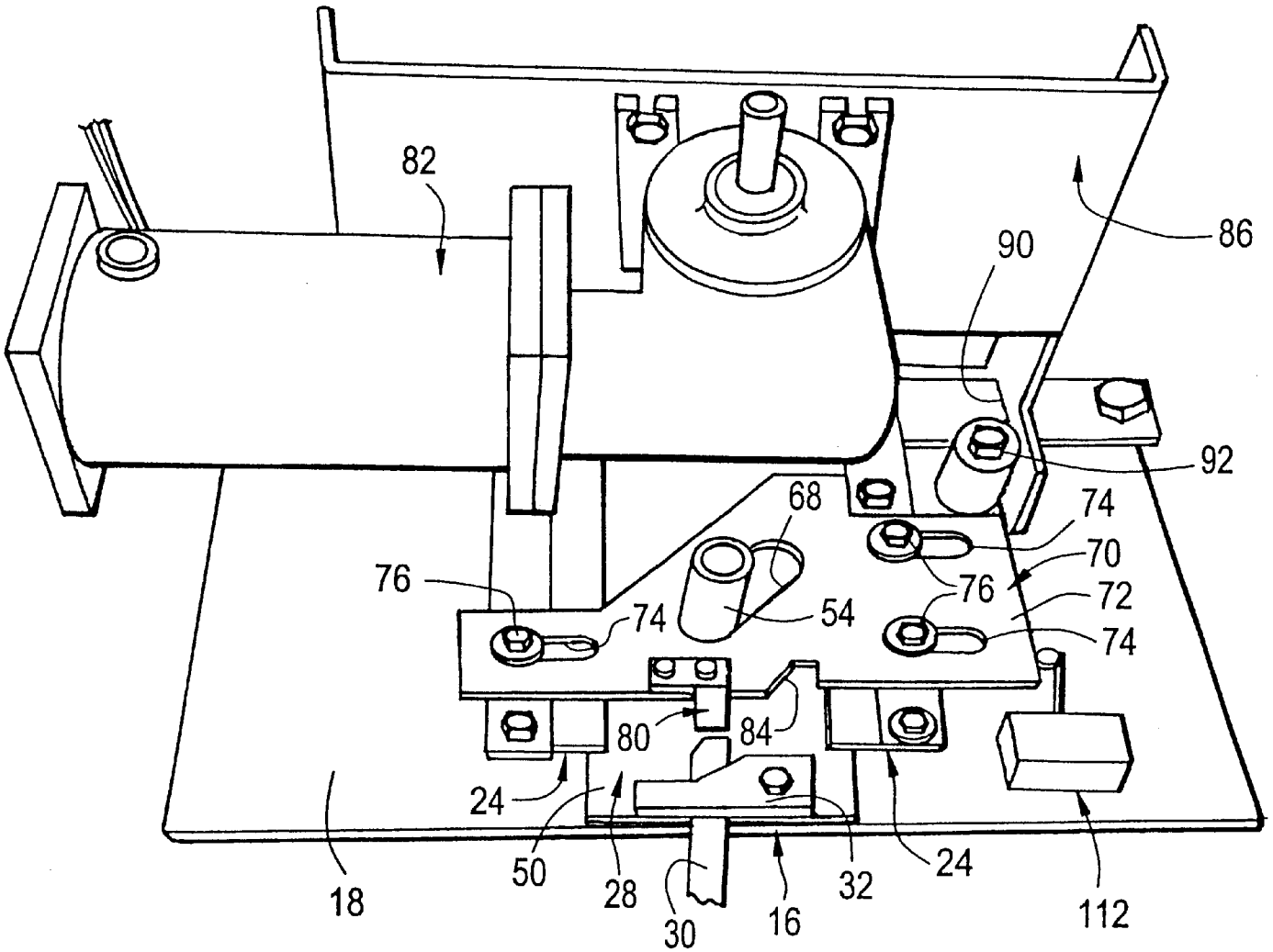
FIG. 9 is a bottom perspective view of a portion of the mechanism illustrated in FIG. 1, omitting the carriage assembly which has been removed from engagement with a motor of the mechanism.

Operation of the mechanism 10 to open and close the door will now be described in detail. Initially, when the door 12 is closed as shown in FIGS. 1, 2 and 11, the vertical locking mechanism 16 deadlocks the door 12 at the bottom of the door 12 (see FIG. 11). Specifically, if the vertical locking mechanism 16 is provided as being the vertical lock bar 30 and steel ball 36 configuration which was discussed above, the vertical lock bar 30 engages the steel ball 36 into engagement with one of the recesses 38, 40 in the bottom of the door 12. Additionally, when the door 12 is in the closed position, the lockhead member 28 is in its lower position as shown in FIGS. 9–11. Hence, the deadlock lever 70 is not shifted and the vertical locking mechanism obstructing portion 80 is generally vertically aligned over the top of the vertical lock bar 30. Hence, the vertical lock bar 30 cannot be lifted by sticking something under the door 12.

Still further, when the door 12 is in the closed position and the lockhead member 28 is in its lower position, the door stopping portion 54 is generally aligned with the carriage assembly 66 (see FIG. 11) prohibiting the door 12 from being manually pushed open even if the vertical locking mechanism 16 were not engaged. Hence, when the door 12 is in the closed position, the door 12 is double deadlocked with the first deadlock resulting from the vertical locking mechanism 16 engaging the bottom of the door 12 and the second deadlock resulting from the door stopping portion 54 of the lockhead member 28 being aligned next to the carriage assembly 66.

Also, when the door 12 is in the closed position, the carriage assembly 66 trips one of the limit switches 100 (the "closed limit switch") as shown in FIG. 11, thereby indicating to the motor control circuit 106 that the door 12 is closed. As a result, this status is also indicated on the control panel 58 (see FIG. 16). Additionally, the limit switch 112 which is on the mechanism plate 18 (the "lock status switch") is tripped by the deadlock lever 70 as shown in FIGS. 3 and 9. Hence, the limit switch 112 indicates to the motor control circuit 106 that the door 12 is deadlocked, and this is also indicated on the control panel 58 (see FIG. 16).

Preferably, if the door 12 is a three foot wide door, the control panel 58 can be commanded to have the mechanism 110 open the door 12 in six seconds or less. Also, while the door 12 is being opened or closed, the direction of movement of the door 12 preferably can be reversed electrically in mid-travel from the control panel 58.

Upon actuating the control panel 58 to open the door 12, the motor 82 drives the carriage assembly 66, and more specifically, drives the driven portion 130 of the carriage assembly 66. When the driven portion 130 is initially driven by the motor 82, the driven portion 130 moves relative to the following portion 132 of the carriage assembly 66. As the driven portion 130 is driven, the leading incline surface 150 on the carriage assembly 66 engages the door stopping portion 54 of the lockhead member 28 as shown in FIGS. 6 and 12, and the door stopping portion 54 rides up the incline surface 150, causing the lockhead member 28 to rise in the channel 26 (see also FIG. 7) which is defined by the lockhead guides 24. When the lockhead member 28 rises, the deadlock lever 70 shifts sideways (as a result of the door stopping portion 54 riding in the slanted slot 68 in the deadlock lever 70) and the vertical lock bar 30 which is pinned thereto also rises, causing the steel ball 36 to disengage from the bottom of the door 12 (see FIG. 12). As the motor 82 further drives the driven portion 130, the door stopping portion 54 rides along the generally level surface 154 (see FIGS. 7 and 13) which spans the inclined surfaces 150, 152, and the following portion 132, e.g. the travel bar assembly, follows the driven portion 130. Hence, the door 12 begins to open. As the door 12 begins to open, the one limit switch (the "closed limit switch") 100 which had been tripped by the carriage assembly 66 is no longer tripped, and this indicates to the motor control circuit 106 that the door 12 is not in the closed position. This status is also reported on the control panel 58 (see FIG. 16). Additionally, as the door 12 begins to open, the deadlock lever 70 shifts. Therefore, the limit switch 112 which is provided on the mechanism plate 18 (the "lock status switch") is no longer tripped by the deadlock lever 70. This indicates to the motor control circuit 106 that the door 12 is not deadlocked, and the control panel 58 also reports this status.

As the door 12 is driven further open, the door stopping portion 54 rides along the generally level surface 154 to the other, trailing incline surface 152. When the door stopping portion 54 rides down this incline surface 152, the lockhead member 28 drops back down in the channel 26 and the deadlock lever 70 re-shifts back to its original position, as shown in FIGS. 8–11 and 14. As a result, the vertical locking mechanism 16 re-engages the door 12 as shown in FIG. 14 (e.g. the steel ball 36 engages the other recess 40 provided in the bottom of the door 12) and the door stopping portion 54 drops in place next to the carriage assembly 66. Hence, the door 12 becomes double deadlocked in the open position. As the door 12 moves to the open position, the carriage assembly trips the other limit switch 102 (the "open limit switch") as shown in FIG. 14, causing the motor control circuit 106 to stop the motor 82. Additionally, the fact that the door 12 is in the open position is indicated on the control panel 58. When the door 12 is in the open position and the lockhead member 28 is down in the channel 26, the limit switch 112 on the mechanism plate 18 (the "lock status switch") is again tripped by the deadlock lever 70 as shown in FIGS. 8, 9, 11 and 14. Hence, the control panel 58 also indicates that the door 12 is deadlocked.

Likewise, upon actuating the control panel 58 to close the door 12, the motor 82 drives the carriage assembly 66, and more specifically, drives the driven portion 130 of the carriage assembly. When the driven portion 130 is initially driven by the motor 82, the driven portion 130 moves relative to the following portion 132 of the carriage assembly 66. As the driven portion 130 is driven, the incline surface 152 on the carriage assembly 66 engages the door stopping portion 54 of the lockhead member 28 as shown in FIG. 8, and the door stopping portion 54 rides up the incline surface 152, causing the lockhead member 28 to rise in the channel 26 which is defined by the lockhead guides 24. When the lockhead member 28 rises, the deadlock lever 70 shifts sideways (as a result of the door stopping portion 54 riding in the slanted slot 68 in the deadlock lever 70, see FIG. 7 for example) and the vertical lock bar 30 which is pinned thereto also rises causing the steel bar 36 to disengage from the bottom of the door 12 (similar to FIG. 12, but at the other edge of the door). As the motor 82 further drives the driven portion 130, the door stopping portion 54 rides along the generally level surface 154 which spans the inclined surfaces 150, 152, and the following portion 132, e.g. the travel bar assembly, follows the driven portion 130. Hence, the door 12 begins to close. As the door 12 begins to close, the one limit switch 102 (the "open limit switch") which had been tripped by the carriage assembly 66 as shown in FIG. 14 when the door 12 was in the open position is no longer tripped, indicating to the motor control circuit 106 that the door 12 is not in the open position. This is indicated on the control panel 58 (see FIG. 16). Additionally, as the door 12 begins to close, the deadlock lever 70 shifts. Therefore, the limit switch 112 which is provided on the mechanism plate 18 (the "lock status switch") is no longer tripped by the deadlock lever 70. This indicates to the motor control circuit 106 that the door 12 is not deadlocked, and this is also reported on the control panel 58.

As the door 12 is driven further closed, the carriage assembly 66 trips limit switch 104 (the "soft stop limit switch"), if provided, which indicates to the motor control circuit 106 that the door 12 is almost closed. In response, the motor control circuit 106 slows down the motor 82 to effect a soft stop of the door 12. As the door 12 is even further closed, the door stopping portion 54 rides down the other incline surface 150 as shown in FIGS. 6 and 12, the lockhead member 28 drops back down in the channel 26 and the deadlock lever 70 re-shifts. As a result, the vertical locking mechanism 16 re-engages the door 12 (see FIG. 11) (e.g. the steel ball 36 re-engages the first recess 38 provided in the bottom of the door 12) and the door stopping portion 54 drops in place next to the carriage assembly 66. Hence, the door 12 becomes double deadlocked in the closed position. As the door 12 moves to the completely closed position, the carriage assembly 66 trips limit switch 100 (the "closed limit switch") (see FIG. 11) causing the motor control circuit 106 to stop the motor 82. Additionally, the fact that the door 12 is in the closed position is indicated on the control panel 58. When the door 12 is in the closed position and the lockhead member 28 is down in the channel 26, the limit switch 112 on the mechanism plate 18 (the "lock status switch") is tripped by the deadlock lever 70. Hence, the control panel 58 also indicates that the door 12 is deadlocked.

In addition to using the control panel 58 to direct the motor control circuit 106 to drive the carriage assembly 66 to open or close the door 12, the control panel 58 and motor control circuit 106 may also be configured to actuate the master bar 56. In such a case, the master bar 56 shifts and lifts the lockhead member 28 as shown in FIG. 15. Hence, the door 12 becomes double unlocked, and the door 12 can be manually opened or closed. However, the motor 82 does remain engaged with the carriage assembly 66, therefore the door 12 is not freewheeling. As mentioned above, the master bar 56 also may be, configured to be actuated by a key in a release column 60 (see FIG. 1), such as during routine use or in case of emergency or a power failure.

As shown, it is preferred that the lockhead member 28, the deadlock lever 70 and the motor bracket 86 be secured to the mechanism plate 18. Hence, the arrangement of components is generally centralized on the mechanism plate 18 above the central column 22 of the door 12 as shown in FIG. 1. This renders the overall mechanism 10 particularly quick and easy to install or replace.

The mechanism 10 is also easy to configure for either a right-handed or left-handed door, and this will now be described in more detail. As discussed above, the motor drive assembly 106 operates the motor 82 based on what is sensed by the limit switches 100, 102, 104 and what commands are received by the control panel 58. Particularly, tripping of the limit switches 100, 102 causes the motor control circuit 106 to stop the motor 82, or slow the motor 82 down (in case the soft stop limiting switch 104 is tripped), and causes the correct status of the door 12 to be indicated on the control panel 58. While many prior art door locking systems provide a limit switch at each edge of a door and that the limit switches are connected to a motor control circuit, the one limit switch is configured to indicate to the circuit that the door is closed and the other is configured to cause the circuit to stop the motor. In contrast, motor control circuit 106 provides that the limit switches 100, 102 can be reconfigured upon switching one or more switches 172, 174 ("door type selection switches") on the motor control circuit as shown in FIGS. 4 and 16.

Specifically, a first door type selection switch 172 defines the functioning of the limit switch 100 which is proximate the one end of the door 12 when the door 12 is closed, and the second door type selection switch 174 defines the functioning of the limit switch 102 which is proximate the other end of the door 12 when the door 12 is closed. Regardless of the setting of the two switches 172, 174, both limit switches 100, 102 dictate when the motor control circuit 106 stops the motor 82. However, upon both door type selection switches 172, 174 being in one position (for example, for a "left-handed door"), the one limit switch 100 dictates when the door 12 is indicated as being closed, and upon both door type selection switches 172, 174 being in the other, opposite position (for example, for a "right-handed door"), the other limit switch 102 dictates when the door 12 is indicated as being closed. In other words, when the door type selection switches 172, 174 are placed in one setting, the one limit switch 100 is defined as the "closed limit switch" and the other 102 is defined as the "open limit switch." When the door type selection switches 172, 174 are placed in the other setting, the roles of the limit switches 100 and 102 are swapped. In other words, the "closed limit switch" becomes the "open limit switch" and the "closed limit switch" becomes the "open limit switch."

For example, as shown in FIG. 4, when both switches 172, 174 are set to the left, both the right and left limit switches 100, 102 as shown in FIG. 3 (and FIGS. 11 and 14) direct the motor control circuit 106 to stop the motor 82 (when either is tripped), and the left limit switch 100 directs (when tripped) the control panel 58 to indicate that the door 12 is closed. In contrast, when both switches 172, 174 are set to the right, both the right and left limit switches 100, 102 direct the motor control circuit 106 to stop the motor 82 (when either is tripped), and the right limit switch 102 directs (when tripped) the control panel 58 to indicate that the door 12 is closed. Hence, overall, the mechanism 10 is not generally "handed" in the sense that other door locking mechanisms are. While other door locking mechanisms provide that several parts must be replaced to use a right-handed mechanism with a left-handed door, and vice versa, a mechanism which is in accordance with an embodiment of the present invention provides that the mechanism 10 can be re-configured for the other type of door merely by switching one or more switches 172, 174. Of course, it is possible to combine the two door type selection switches 172, 174 into a single switch. Regardless, any door type selection switch which is provided may be provided, for example, on the relay connection board 110 which was referred to above.

While both a rack and pinion mechanism (134, 88) and a chain drive mechanism have been mentioned hereinabove, another embodiment of the present invention may provide that the motor 82 directly drives the lockhead member 28. In such a case, the motor 82 may drive a cam surface which is engaged with an edge of the lockhead member 28. While the rack and pinion and the chain drive embodiments provide that mechanism can both lock/unlock and open and close a door, this third embodiment would provide that the mechanism only locks or unlocks the door. Of course, in such an embodiment, it is preferred that the mechanism still provide a double deadlocking feature and still indicate on the control panel 58 when the door is deadlocked.

Regardless of which embodiment is employed, it is preferred that each be housed in a durable housing, such as a horizontal housing which is generally mounted on L-brackets. The housing may be formed from 7 gauge steel, and may include a hinged cover which is formed from 10 gauge steel. Preferably, all housing openings are baffled to deflect the insertion of any foreign objects. Preferably, the cover is attached to the housing with pinned, Torx® head machine screws. The release column 60 may include hard rubber bumpers which cushion the impact of the door 12 when it closes. The release column 60 may also house an intercom speaker. Still other features and alternatives would be recognized by one having ordinary skill in the art.

While embodiments of the present invention are shown and described, it is envisioned that those skilled in the art may devise various modifications and equivalents without departing from the spirit and scope of the invention as defined by the appended claims. The invention is not intended to be limited by the foregoing disclosure.

What is claimed is:

1. A door locking mechanism for double deadlocking a door, said door locking mechanism comprising: a lockhead member including a door stopping portion, said lockhead member moveable from a locked position wherein the door is double deadlocked and an unlocked position; a vertical locking mechanism coupled to the lockhead member, said vertical locking mechanism deadlocking said door when said lockhead member is in the locked position, said door stopping portion of said lockhead member also deadlocking said door when said lockhead member is in the locked position; a carriage assembly engaged with the door, said carriage assembly including at least one surface for engaging said door stopping portion and moving said lockhead member from the locked position to the unlocked position, wherein said vertical locking mechanism disengages said door when said lockhead member is in the unlocked position and said door stopping portion of said lockhead member also disengages said door when said lockhead member is in the unlocked position; and a motor driveably engaged with said carriage assembly, wherein movement of said carriage assembly causes the carriage assembly to engage the door stopping portion of the lockhead member and move the lockhead member to the unlocked position, further comprising a motor control circuit including a first limit switch for sensing said carriage assembly, a second limit switch for sensing said carriage assembly, and at least one indicating device for indicating a position of the door, wherein the first and second limit switches are in communication with the indicating device, wherein said motor control circuit further includes at least one switch which is operable to select which one of the first and second limit switches dictates what status is indicated by the indicating device when the door is in a given position.

2. A door locking mechanism as recited in claim 1, further comprising a deadlock lever operatively associated with said lockhead member such that movement of said lockhead member causes movement of said deadlock lever, said deadlock lever including a vertical locking mechanism obstructing portion, said vertical locking mechanism obstructing portion generally aligning with said vertical locking mechanism when said lockhead member is in the locked position whereby said vertical locking mechanism is prevented from being manually disengaged from the door, said vertical locking mechanism obstructing portion generally dis-aligning with said vertical locking mechanism when said lockhead member is moved to the unlocked position thereby providing that said vertical locking mechanism disengages from the door upon the lockhead member moving to the unlocked position.

3. A door locking mechanism as recited in claim 2, wherein said lockhead member comprises a first plate and said deadlock lever comprises a second plate, said lockhead member being generally keyed to said deadlock lever, said door stopping portion of said lockhead member being received in a slot in said second plate.

4. A door locking mechanism as recited in claim 3, said door stopping portion of said lockhead member comprising a roller which is pinned to said first plate.

5. A door locking mechanism as recited in claim 1, further comprising a mechanism plate having a channel defined thereon, wherein said lockhead member is slidable in said channel from the locked position to the unlocked position.

6. A door locking mechanism as recited in claim 5, wherein said lockhead member comprises a first plate and said deadlock lever comprises a second plate, said lockhead member being generally keyed to said deadlock lever, said first plate having a first roller pinned thereto, said door stopping portion of said lockhead member comprising a second roller which is received in a slot in said second plate, said door locking mechanism further comprising a bar which is engageable with said first roller to move said lockhead member from the locked position to the unlocked position.

7. A door locking mechanism as recited in claim 1, wherein said carriage assembly includes at least one of a geared rack and a chain section and said motor drives at least one of a pinion and a sprocket which is engaged with at least one of the geared rack and chain section of the carriage assembly.

8. A door locking mechanism as recited in claim 1, wherein said carriage assembly includes a travel bar assembly which includes a plurality of rollers which are engaged with a guide member.

9. A door locking mechanism as recited in claim 1, wherein said carriage assembly includes a driven portion which is engaged and is driveable by said motor, said driven portion engageable with said door stopping portion, wherein said carriage assembly includes a following portion comprising a travel bar assembly which includes a plurality of rollers which are engaged with a guide member, wherein said driven portion and said following portion are operatively engaged with each other to provide that said driven portion is moveable relative to said following portion for a length of travel of said driven portion wherein said driven portion engages said door stopping portion thereby causing said door stopping portion to move out of a direction of subsequent travel of said following portion which results upon further movement of said driven portion.

10. A door locking mechanism as recited in claim 1, wherein both the first and second limit switches dictate the length of door travel, said motor control circuit including at least one switch which is operable to select the direction to which the door travels.

11. A door locking mechanism as recited in claim 1, further comprising a deadlock lever operatively associated with said lockhead member such that movement of said lockhead member causes movement of said deadlock lever, said deadlock lever including a vertical locking mechanism obstructing portion, said vertical locking mechanism obstructing portion generally aligning with said vertical locking mechanism when said lockhead member is in the locked position whereby said vertical locking mechanism is prevented from being manually disengaged from the door, said vertical locking mechanism obstructing portion generally dis-aligning with said vertical locking mechanism when said lockhead member is moved to the unlocked position thereby providing that said vertical locking mechanism disengages from the door upon the lockhead member moving to the unlocked position; and a mechanism plate having a channel defined thereon, wherein said lockhead member is slidable in said channel from the locked position to the unlocked position.

12. A door locking mechanism for deadlocking a door, said door locking mechanism comprising: a lockhead member including a door stopping portion; a carriage assembly engaged with the door, said carriage assembly including a driven portion and a following portion; a motor driveably engaged with the driven portion of the carriage assembly, said driven portion engaged with said following portion such that said driven portion is movable relative to the following portion for a first portion of a range of movement of the driven portion and said following portion is pulled by said driven portion for a second portion of the range of movement of the driven portion, said driven portion including a surface which engages said door stopping portion of said lockhead member during the first portion of the range of movement of the driven portion thereby moving said door stopping portion such that said following portion of said carriage assembly is pullable by said driven portion during the second portion of the range of movement of the driven portion, thereby moving the door, wherein said lockhead member comprises a plate and said door stopping portion comprises a roller pinned to said plate, further comprising a deadlock lever operatively associated with said lockhead member such that movement of said lockhead member causes movement of said deadlock lever, said deadlock lever including a vertical locking mechanism obstructing portion, said vertical locking mechanism obstructing portion generally aligning with said vertical locking mechanism when said lockhead member is in the locked position whereby said vertical locking mechanism is prevented from being manually disengaged from the door, said vertical locking mechanism obstructing portion generally dis-aligning with said vertical locking mechanism when said lockhead member is moved to the unlocked position thereby providing that said vertical locking mechanism disengages from the door upon the lockhead member moving to the unlocked position; and a mechanism plate having a channel defined thereon, wherein said lockhead member is slidable in said channel from the locked position to the unlocked position, wherein said deadlock lever is keyed to said mechanism plate, further comprising a motor control circuit including a first limit switch for sensing said carriage assembly, a second limit switch for sensing said carriage assembly, and at least one indicating device for indicating the position of the door, wherein the first and second limit switches are in communication with the indicating device, wherein said motor control circuit further includes at least one switch which is operable to select which one of the first and second limit switches dictates what status is indicated by the indicating device when the door is in a given position.

13. A door locking mechanism for locking a door, said door locking mechanism comprising: a lockhead member including a door stopping portion, said lockhead member moveable from a locked position wherein the door is locked and an unlocked position; a vertical locking mechanism coupled to the lockhead member, said vertical locking mechanism locking said door when said lockhead member is in the locked position, said door stopping portion of said lockhead member also locking said door when said lockhead member is in the locked position; a carriage assembly engaged with the door, said carriage assembly including at least one surface for engaging said door stopping portion and moving said lockhead member from the locked position to the unlocked position, wherein said vertical locking mechanism disengages said door when said lockhead member is in the unlocked position and said door stopping portion of said lockhead member also disengages said door when said lockhead member is in the unlocked position; and a motor driveably engaged with said carriage assembly but not carried thereby, wherein movement of said carriage assembly causes the carriage assembly to engage the door stopping portion of the lockhead member and move the lockhead member to the unlocked position, further comprising a deadlock lever operatively associated with said door stopping portion of said lockhead member such that movement of said lockhead member causes movement of said deadlock lever, said deadlock lever including a vertical locking mechanism obstructing portion, said vertical locking mechanism obstructing portion generally aligning with said vertical locking mechanism when said lockhead member is in the locked position whereby said vertical locking mechanism is prevented from being manually disengaged from the door, said vertical locking mechanism obstructing portion generally dis-aligning with said vertical locking mechanism when said lockhead member is moved to the unlocked position thereby providing that said vertical locking mechanism disengages from the door upon the lockhead member moving to the unlocked position.

14. A door locking mechanism as recited in claim 13, wherein said deadlock lever is separate from and not carried by said carriage member.

15. A door locking mechanism as recited in claim 13, wherein said deadlock lever is at all times in contact with said lockhead member.

16. A door locking mechanism as recited in claim 13, further comprising a mounting plate which is mountable at a height which is above a height of the door, wherein the lockhead member is carried by the mounting plate, further comprising a motor ultimately mounted to the mounting plate and driveably engaged with said carriage assembly.

17. A door locking mechanism as recited in claim 16, wherein the deadlock lever is carried by the mounting plate.

18. A door locking mechanism as recited in claim 13, wherein the door stopping portion of the lockhead member comprises a roller.

19. A door locking mechanism as recited in claim 18, wherein said roller extends through a slot in said deadlock lever.

* * * * *

UNITED STATES PATENT AND TRADEMARK OFFICE

CERTIFICATE OF CORRECTION

PATENT NO. : 6,585,303 B1
DATED : July 1, 2003
INVENTOR(S) : Ronald Coose and Brian Pavey It is certified that error appears in the above-identified patent and that said Letters Patent is hereby corrected as shown below:

Column 9,
Line 60, "110 open" should be -- 10 open --

Signed and Sealed this

Twenty-third Day of September, 2003

JAMES E. ROGAN
*Director of the United States Patent and Trademark Office*